US005947368A

United States Patent [19]

Thresher et al.

[11] Patent Number: 5,947,368

[45] Date of Patent: Sep. 7, 1999

[54] FOLDING CARTON AND BLANK WITH RECLOSURE MEANS

[75] Inventors: Glen A. Thresher, Big Flats; Karl F. DeMay, Newark, both of N.Y.

[73] Assignee: Fold-Pak Corporation

[21] Appl. No.: 08/850,378

[22] Filed: May 2, 1997

[51] Int. Cl.[6] ..... B65D 5/54

[52] U.S. Cl. ..... 229/208; 229/226; 229/228; 229/905

[58] Field of Search ..... 229/145, 148, 229/208, 209, 224, 226, 228, 905

[56] References Cited

U.S. PATENT DOCUMENTS

| | | | |
|---|---|---|---|
| Re. 33,204 | 4/1990 | Froom . | |
| 3,073,501 | 1/1963 | Williamson | 229/145 |
| 3,295,742 | 1/1967 | Coe | 229/145 |
| 3,295,743 | 1/1967 | Redpath et al. | 229/208 |
| 3,338,505 | 8/1967 | Hughes | 229/145 |
| 3,432,090 | 3/1969 | Engel | 229/226 |
| 3,595,466 | 7/1971 | Rosenburg, Jr. | 229/208 |
| 4,048,052 | 9/1977 | Tolaas | 229/224 |
| 4,113,104 | 9/1978 | Meyers | 229/228 |
| 4,314,643 | 2/1982 | Forbes, Jr. | 229/145 |
| 4,436,206 | 3/1984 | Kuchenbecker | 229/208 |
| 4,679,694 | 7/1987 | Donohie et al. . | |
| 4,712,689 | 12/1987 | Froom . | |
| 4,712,730 | 12/1987 | Froom . | |
| 4,749,086 | 6/1988 | Donohie . | |
| 4,756,470 | 7/1988 | DePaul . | |
| 4,757,902 | 7/1988 | Hutchinson et al. . | |
| 4,819,864 | 4/1989 | Capuano . | |
| 4,826,074 | 5/1989 | DePaul . | |
| 4,838,432 | 6/1989 | DePaul . | |
| 4,872,609 | 10/1989 | DePaul . | |
| 5,033,622 | 7/1991 | DePasquale et al. . | |
| 5,160,082 | 11/1992 | McCormick et al. . | |
| 5,288,012 | 2/1994 | DeMay . | |
| 5,351,881 | 10/1994 | DeMay . | |
| 5,409,160 | 4/1995 | DeMay . | |
| 5,411,204 | 5/1995 | DeMay . | |
| 5,474,231 | 12/1995 | Froom . | |
| 5,484,102 | 1/1996 | DeMay . | |
| 5,588,584 | 12/1996 | DeMay . | |

FOREIGN PATENT DOCUMENTS

| | | | |
|---|---|---|---|
| 1569002 | 6/1980 | United Kingdom | 229/145 |

*Primary Examiner*—Gary E. Elkins
*Attorney, Agent, or Firm*—Pillsbury Madison & Sutro LLP

[57] ABSTRACT

A folding carton is described having locking means constructed entirely from paperboard stock to provide unique reclosure and reseal characteristics for a top opening lid.

68 Claims, 23 Drawing Sheets

FOLDING CARTON AND BLANK WITH RECLOSURE MEANS

BACKGROUND OF THE INVENTION

1. Field of the Invention

The present invention relates generally to folding paperboard cartons and, more particularly, to a carton blank used for assembling a carton having an enhanced appearance and novel reclosure means.

2. Brief Description of the Prior Art

Folding cartons are well known in the packaging art. These cartons are constructed from flat blanks which are pre-cut and pre-scored on paperboard sheets. Carton blanks have five main panels which are adapted to form the cover, top, rear, bottom and front of an assembled carton. Each panel has a pair of end flaps which are hingedly connected by score lines formed in the paperboard.

Carton blanks are typically produced on large paperboard sheets in a multiple configuration. Individual blanks are internally "nested" on three sides to minimize the amount of excess or wasted paperboard. During the blanking operation, score lines are provided to facilitate a pre-selected flap-folding sequence. Perforations are also die-cut in the paperboard to form art-recognized tear-away and breakaway features. Score lines and perforations are created by die-stamping and die-cutting the paperboard blanks in a single, downward direction.

The carton blanks are folded over and secured with known adhesives to form carton sleeves which are typically used for packaging semi-solid consumables. During the form-filling operation, packaging machinery is used to form, fill and seal fully assembled cartons according to the prescribed folding sequence and adhesive pattern.

Numerous carton designs for packaging ice cream and the like are available. For example, commercial products of the type described in U.S. Pat. Nos. 4,679,694, 4,712,689, 4,712,730, 4,749,086, 4,756,470, 4,757,902, 4,819,864, 4,826,074, 4,838,432, 4,872,609, 5,033,622, 5,160,082 and Re. 33,204 (incorporated by reference herein) are manufactured and sold by Fold-Pak Corporation, Newark, N.Y. under the HI TECH® trade designation.

Additional carton designs are presented in U.S. Pat. Nos. 5,288,012, 5,351,881, 5,409,160, 5,411,204, 5,474,231, 5,484,102 and 5,588,584 (all incorporated herein by reference) which describe state-of-the-art blanks used to assemble a rectangular, top opening carton. Containers of the type described in these patents are manufactured and sold under license from Fold-Pak Corporation.

To construct such a carton, first and second ends are closed by folding the bottom panel end flaps first, front panel end flaps second, top panel end flaps third and rear panel end flaps fourth and last. Prior to folding in the fourth down flap, single lines of adhesive are deposited on the previously folded end flaps. All four end flaps are secured by single glue lines to form a smooth, continuous wall at first and second ends of the carton.

In the form-filling operation, end flaps disposed adjacent a first end are folded in and adhesively secured to form one end of a carton. A filler head is aligned with the second, open end to dispense ice cream or the like, in a semi-solid state, into the partially constructed carton. Once filled, the end flaps of the open end are closed and adhesively secured to form a sealed carton.

To facilitate opening of a sealed carton and subsequent reclosure, a horizontal tear-away strip is die-stamped on the cover panel and breakaway corner tabs are similarly cut on rear panel end flaps during the blanking operation. When the cover panel is glued to the front panel to form a carton sleeve, care is taken to avoid adhesion of the tear-away strip so that it is readily removed by a consumer. During form-filling, care is taken to ensure adhesion of the breakaway corner tabs to corresponding top panel end flaps.

A consumer opens a sealed carton by removing the tear-away strip from the cover panel along pre-cut perforations. The carton seal is broken as the lid (comprised of the top and cover panels) is lifted away from the remainder of the carton, and the breakaway corner tabs (adhered to top panel end flaps) are separated from their respective rear panel end flaps.

Problems are sometimes encountered because the lid does not provide secure reclosure after the initial opening. With extended freezer storage a gap may develop between the body of the carton and the lid. This gap may lead to "freezer burn" or loss of freshness for a stored food product. In addition, the detached tear-away strip leaves behind two rows of unsightly "sawtooth" edges which do not aid reclosure or contribute aesthetic appeal.

Form failure problems can also arise if a partially filled carton collapses because of structural instability. It has been discovered that structural instability is partially caused by attaching the edge of the cover panel to the front panel so that the tear-away strip can be easily removed. And, the frequency of form failure depends on where the tear-away strip is positioned relative to the front panel.

The rectangular, top-opening cartons described above are cheaper to produce than bucket or pail-type ice cream barrels. As a result, bucket-type barrels are used to package "premium" or "upscale" products which can absorb the added costs. An advantage of the present invention is a hinged lid with the "look" of more expensive circular lids for bucket-type barrels.

This disclosure presents a paperboard blank configured to produce a carton which entirely eliminates the form failure attributed to tear-away strips. It also describes a unique reclosure means for easy handling during end use application of a carton.

OBJECTS OF THE INVENTION

Accordingly, it is a general object of the present invention to provide a carton for packaging semi-solid consumables such as ice cream and the like.

Another object of the present invention is to provide a plurality of interlocking reclosure means for easy opening, improved reclosure, reseal and durable storage of a paperboard carton.

Yet another object of the present invention is to provide a plurality of reclosure means constructed entirely from paperboard which is die-cut during the blanking operation.

A further object of the present invention is to provide a blank with unique top panel and rear panel end flaps which cooperate to avoid paperboard buildup in the end walls and facilitate form-filling into a carton.

Yet another object of the present invention is to provide a rectangular, top opening carton having a hinged lid with an upscale appearance and the "look" of a separate, premium lid.

Other objects of the present invention will be apparent to those skilled in the relevant art.

SUMMARY OF THE INVENTION

One aspect of the present invention is a carton assembled from a foldable blank and intermediate sleeve. The carton comprises cover, top, rear, bottom and front panels hingedly connected in the order named, with the cover, top, rear, bottom and front panels each having left and right ends. An in-folding flap is connected to the cover panel by a score line. The in-folding flap has an unfinished inner surface, an outer surface and a locking edge. The score line enables the in-folding flap to join the unfinished surface of the cover panel, and underlie the cover panel, when the carton is assembled.

Left and right top panel end flaps hingedly connect to the left and right ends of the top panel. The left top panel end flap has a first smooth edge terminating in a first relief notch and the right top panel end flap has a second smooth edge terminating in a second relief notch.

Left and right rear panel end flaps hingedly connect to the left and right ends of the rear panel. The left rear panel end flap has a third smooth edge and the right rear panel end flap has a fourth smooth edge. Left and right bottom panel end flaps hingedly connect to the left and right ends of the bottom panel and left and right front panel end flaps hingedly connect to the left and right ends of the front panel. The front panel has at least one sealing surface and a hingedly connected flange lip. The carton is made of paperboard and the sealing surface is die-cut to a depth of at least one-eighth, and preferably one-half, the thickness of the paperboard.

The unfinished inner surface of the in-folding flap is adhesively connected to the cover panel and the underlying outer surface of the in-folding flap is adhesively connected to the sealing surface on the front panel. As a result, the flange lip connected to the front panel substantially engages the locking edge of the in-folding flap.

To assemble the carton, bottom panel end flaps are folded first, front panel end flaps are folded second to overlie portions of the bottom panel end flaps, top panel end flaps are folded third and rear panel end flaps are folded last so that the third and fourth smooth edges overlie the first and second smooth edges, respectively. In this configuration, the first relief notch on the first smooth edge substantially engages the left rear panel end flap and the second relief notch on the second smooth edge substantially engages the right rear panel end flap.

Alternatively, the carton may have a plurality of sealing surfaces on the front panel and the underlying outer surface of the in-folding flap is adhesively connected to said plurality of sealing surfaces on the front panel.

In another embodiment of the present invention, the carton comprises an in-folding flap which has a releasable lock tab defined by a perforated border and inside and outside surfaces. The unfinished inner surface of the in-folding flap is adhesively connected to the cover panel with the inside surface of the lock tab being free of adhesive. The outside surface of thee lock tab is adhesively connected to the front panel. In this configuration, the lock tab is adapted for release from the perforated border when the seal of the carton is broken. It is also adapted to lock with the perforated border when the carton is resealed.

Alternative cartons include a plurality of releasable lock tabs on the in-folding flap defined by a plurality of corresponding perforated borders. The inside surfaces of the lock tabs are free of adhesive, while the outside surfaces of the lock tabs are adhesively connected to the front panel. In this embodiment, the lock tabs are adapted for release from the corresponding perforated borders when the seal of the carton is broken. Once again, the lock tabs are adapted to lock with the corresponding perforated borders when the carton is resealed.

In another embodiment, the carton has an in-folding flap connected to a cover panel, with the in-folding flap having a locking edge. The front panel in this embodiment is connected to a lip by a solid or perforated joint line having at least one male tab which engages the locking edge of the in-folding flap. Variations to this embodiment include a carton having a plurality of male tabs in the joint line which engage the locking edge of the in-folding flap. The male tab(s) may be formed by die-cuts through the entire thickness of the paperboard or may be cut to a depth between one-quarter to three-quarters of the paperboard thickness.

The carton may also have a die-cut appendage formed in the score line connecting the in-folding flap to the cover panel. This appendage is used by a consumer to break the seal of the carton and access its contents.

DETAILED DESCRIPTION OF THE INVENTION

Figure 1:
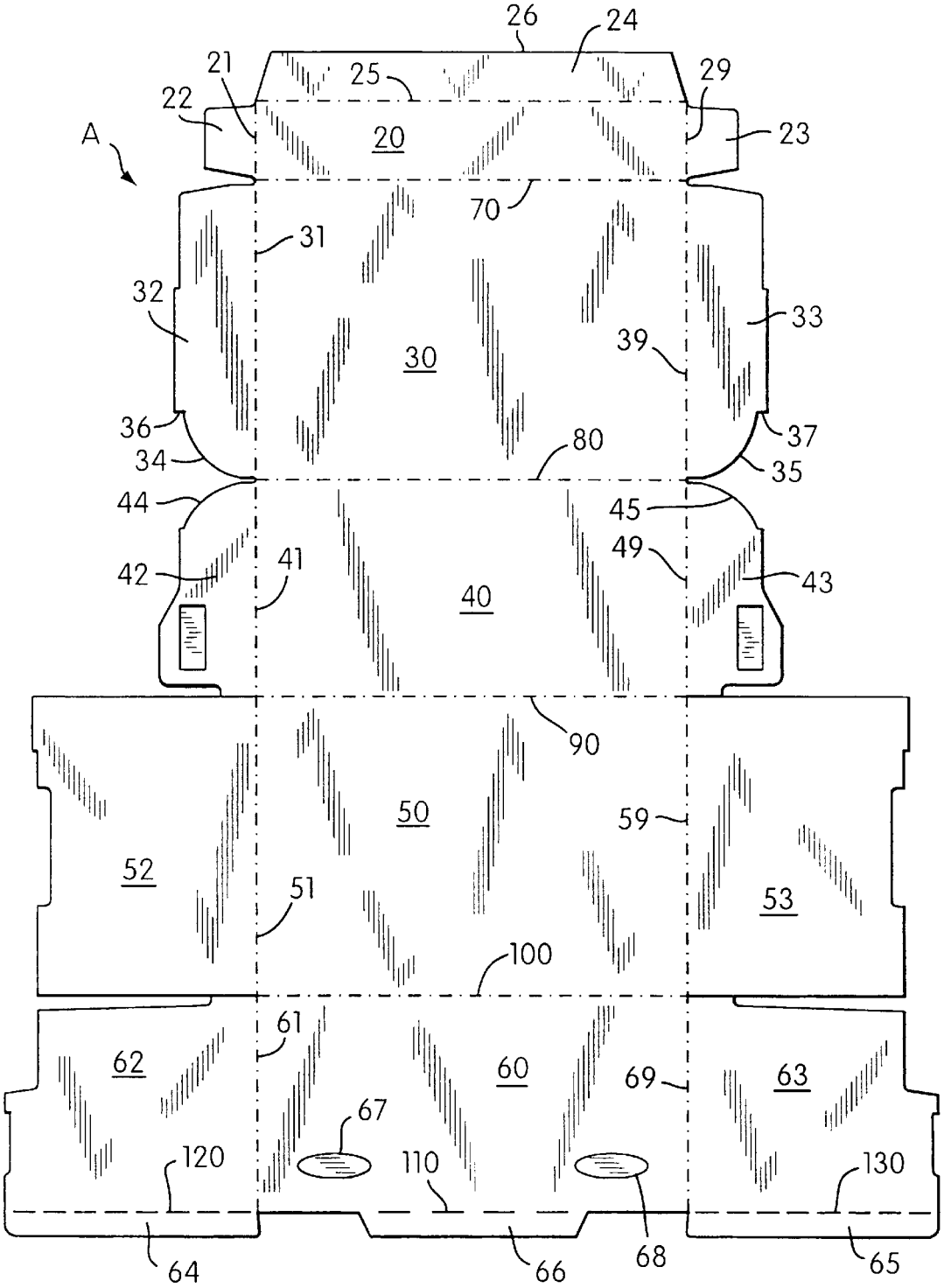
FIG. 1 shows blank A of the first embodiment featuring a locking edge, flange lip and elliptical sealing surfaces in their original condition.

Referring to FIG. 1, the first embodiment of the present invention will now be described. Carton blank A is comprised of five main panels, cover panel 20, top panel 30, rear panel 40, bottom panel 50 and front panel 60. Cover panel 20 is hingedly connected by score lines 21 and 29 to cover panel end flaps 22 and 23, respectively. Cover panel 20 is also hingedly connected by score line 25 to in-folding flap 24. In-folding flap 24 terminates at locking edge 26.

The plan view surface of blank A shown in FIG. 1 is the outer print side which typically displays colorful graphics identifying the contents of a filled carton. The opposite side (not shown) is the inner unfinished side which constitutes the lining of a form-filled carton. As used herein, the term "in-folding" refers to flap 24 which folds at score line 25 so that the unfinished side of in-folding flap 24 meets the unfinished side of cover panel 20 for adhesive attachment.

Top panel 30 is hingedly connected by score lines 31 and 39 to top panel end flaps 32 and 33, respectively. Top panel end flaps 32 and 33 have smooth edges 34 and 35. Disposed adjacent smooth edge 34 is relief notch 36, and adjacent smooth edge 35 is relief notch 37. Rear panel 40 is hingedly connected by score lines 41 and 49 to rear panel end flaps 42 and 43. Rear panel end flaps 42 and 43 have smooth edge portions 44 and 45.

Bottom panel 50 is shown hingedly connected by score lines 51 and 59 to respective bottom panel end flaps 52 and 53. Front panel 60 is shown hingedly connected by score lines 61 and 69 to front panel end flaps 62 and 63. Front panel 60 is connected to flange lip 66 by joint line 110 formed as a solid score or perforation. Front panel end flaps 62 and 63 are connected with respective joint lines 120 and 130 to lips 64 and 65. Additionally, front panel 60 is shown with two die-cut sealing surfaces 67 and 68.

FIG. 1 shows five main panels hingedly connected to each other by score lines 70, 80, 90 and 100 stamped into the paperboard. Each main panel is hingedly connected to end flaps 22, 32, 42, 52 and 62 by score lines 21, 31, 41, 51 and 61, and end flaps 23, 33, 43, 53 and 63 are hingedly connected to respective main panels by score lines 29, 39, 49, 59 and 69, similarly stamped into the paperboard. All score lines are formed by die-stamping the blanks in a single, downward direction using scoring rules. Score line 25 connecting in-folding flap 24 to cover panel 20 is also die-stamped in the same direction to allow in-folding of the unfinished inner surface of flap 24 so that it can be glued to the unfinished inner surface of cover panel 20.

Carton blank A has a substantially uniform paperboard thickness. Perforations are formed by die-cutting in the same blanking operation which produces the die-stamped score lines. The perforations are cut through the entire thickness of the paperboard in a pattern having intervening spaces of pre-selected length, for example, one-eighth of an inch. Sealing surfaces 67 and 68 are also formed in the single blanking operation which produces the score lines and joint lines. But, the die-cuts defining sealing surfaces 67 and 68 have a depth which is approximately one-half the thickness of the paperboard blank.

Figure 2:
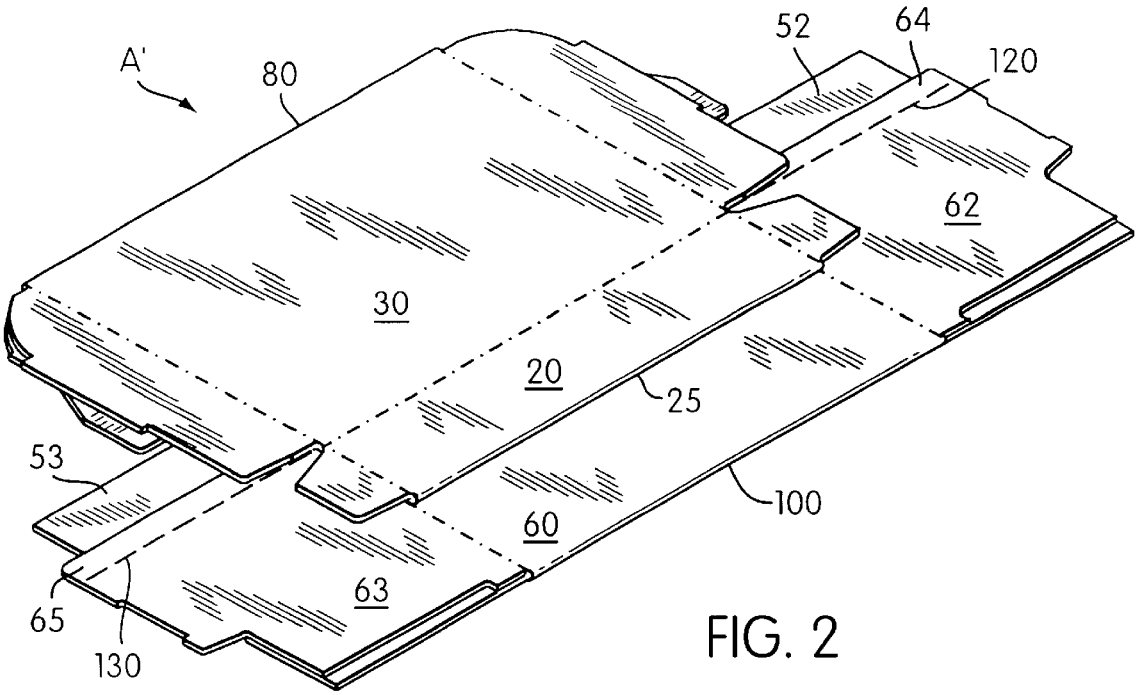
FIG. 2 is a top perspective view of sleeve A'.

FIG. 2 shows sleeve A' which is formed by first folding the blank at score line 25 and gluing the unfinished inner surface (not shown) of in-folding flap 24 to the unfinished inner surface of cover panel 20. The blank is next folded at score lines 80 and 100 and flange lip 66 (shown in FIG. 1) is folded so that its outer print surface joins the outer print surface of front panel 60. Adhesive is then deposited on sealing surfaces 67 and 68 of front panel 60 and the underlying outer surface of in-folding flap 24 is glued to surfaces 67 and 68 to form sleeve A'.

Figure 10:
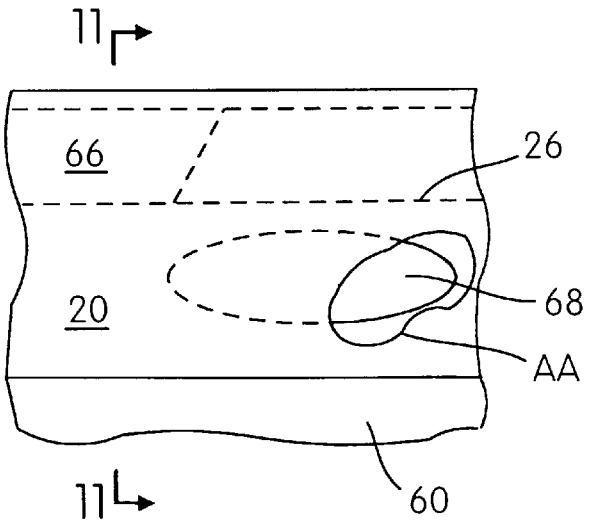
FIG. 10 is a fragmented view of carton A" with its cover panel adhered to its front panel. This figure emphasizes the spatial relationship between an illustrative, elliptical sealing surface and a flange lip which are both shown in phantom lines.

FIG. 10 is a fragmented view of cover panel 20 adhered to front panel 60. It shows the spatial relationship between sealing surface 68 (shown mostly in phantom lines with a portion displayed by partial cutaway view AA through cover panel 20) and flange lip 66 (shown with phantom lines).

Figure 11:
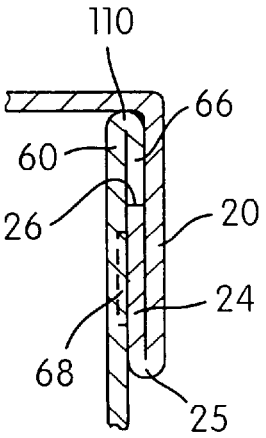
FIG. 11 is a cross-sectional view taken along line 11—11 in FIG. 10 showing the flange lip engaged to the locking edge to be described below.

FIG. 11 is a cross-sectional view taken along line 11—11 in FIG. 10. This figure emphasizes the engagement of locking edge 26 to flange lip 66. In-folding flap 24 is folded at score line 25 and the unfinished inner surface of in-folding flap 24 is shown glued to the unfinished inner surface of cover panel 20. Flange lip 66 connected to front panel 60 is bent at joint line 110 so that the finished surface of flange lip 66 joins the outer print surface of front panel 60. In this configuration, locking edge 26 on in-folding flap 24 substantially engages flange lip 66 connected to front panel 60.

Referring back to FIG. 2, lips 64 and 65 are folded inward along joint lines 120 and 130 and tucked in between the top panel and bottom panel end flaps during a form-filling operation.

Figure 3:
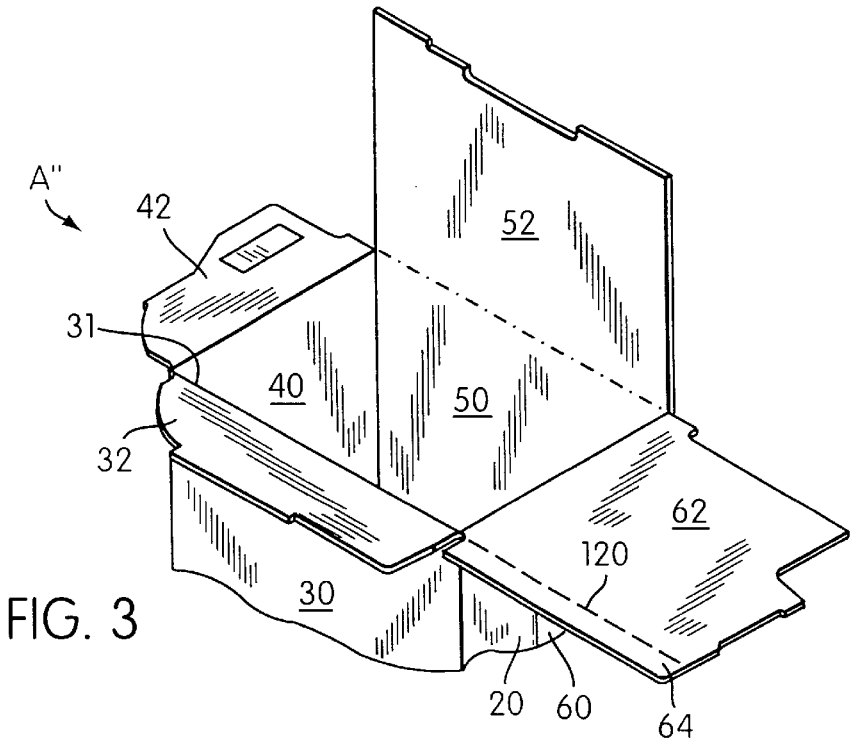
FIG. 3 is a fragmentary perspective view of one, open end of partially assembled carton A" ready for a form-filling operation.

FIG. 3 shows an open end of a partially constructed carton ready for filling. After filling, the open end is closed by folding bottom panel end flap 52 first, then front panel end flap 62 second with lip 64 bent inward along joint line 120 and over bottom panel end flap 52. Top panel end flap 32 is folded third so that lip 64 is tucked in between bottom panel end flap 52 and top panel 30. A single line of adhesive is deposited on the folded end flaps, then rear panel end flap 42 is folded down fourth and last to form a smooth, continuous end wall.

Figure 4:
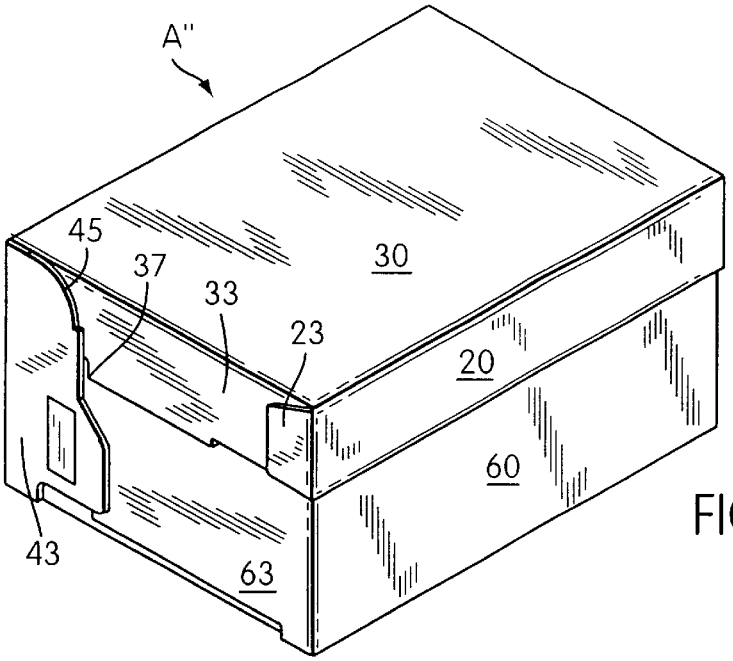
FIG. 4 is a top perspective view of fully constructed and sealed carton A" with cooperating top panel and rear panel end flaps.

FIG. 4 shows a fully sealed carton A". Relief notch 37 is shown engaged to rear panel end flap 43. Smooth edge 45 in combination with relief notch 37 against rear panel end flap 43 provides a flat, co-planar end wall with no paperboard build-up or protrusions.

Figure 5:
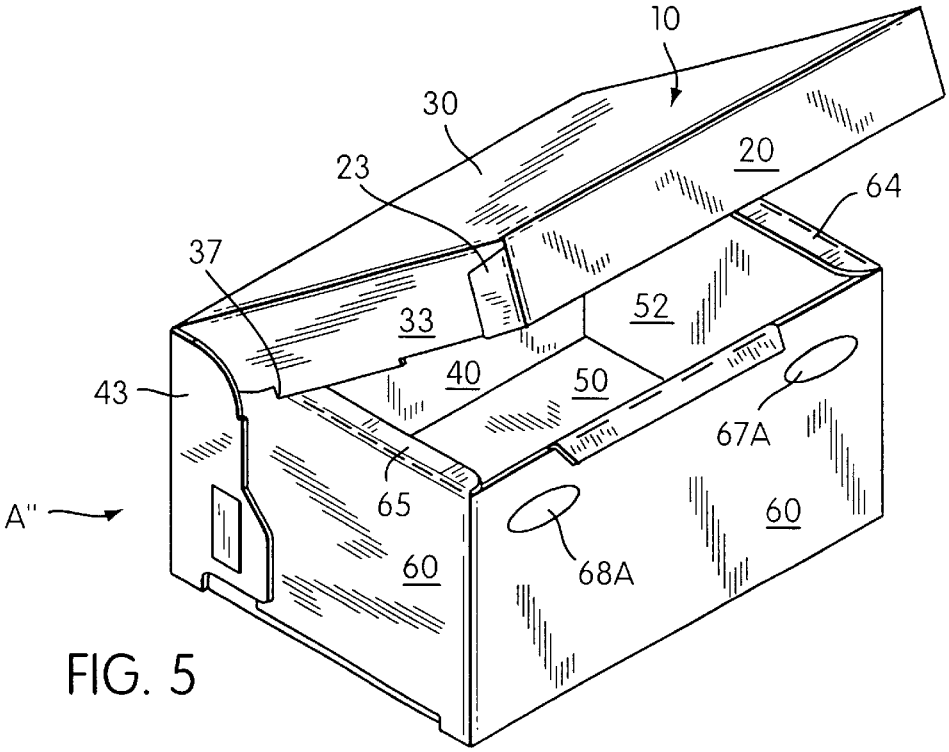
FIG. 5 illustrates carton A" with a flange lip and sealing surfaces in their sheared condition.

FIG. 5 illustrates the carton shown in FIG. 4. The seal is broken and lid 10 is open. To break the seal of carton A", a consumer inserts a digit under cover panel 20 and lifts it away from front panel 60. According to the first embodiment, this action shears approximately half a layer of paperboard along the die-cuts defining sealing surfaces 67 and 68, leaving behind sheared sealing surfaces 67A and 68A having depths which are approximately half the thickness of the paperboard stock.

The illustrative shape of the ellipse provides for easy opening. The tapered ends are sheared away easily with shear gradually increasing as the wider mid-point of the ellipse is approached.

Figure 7:
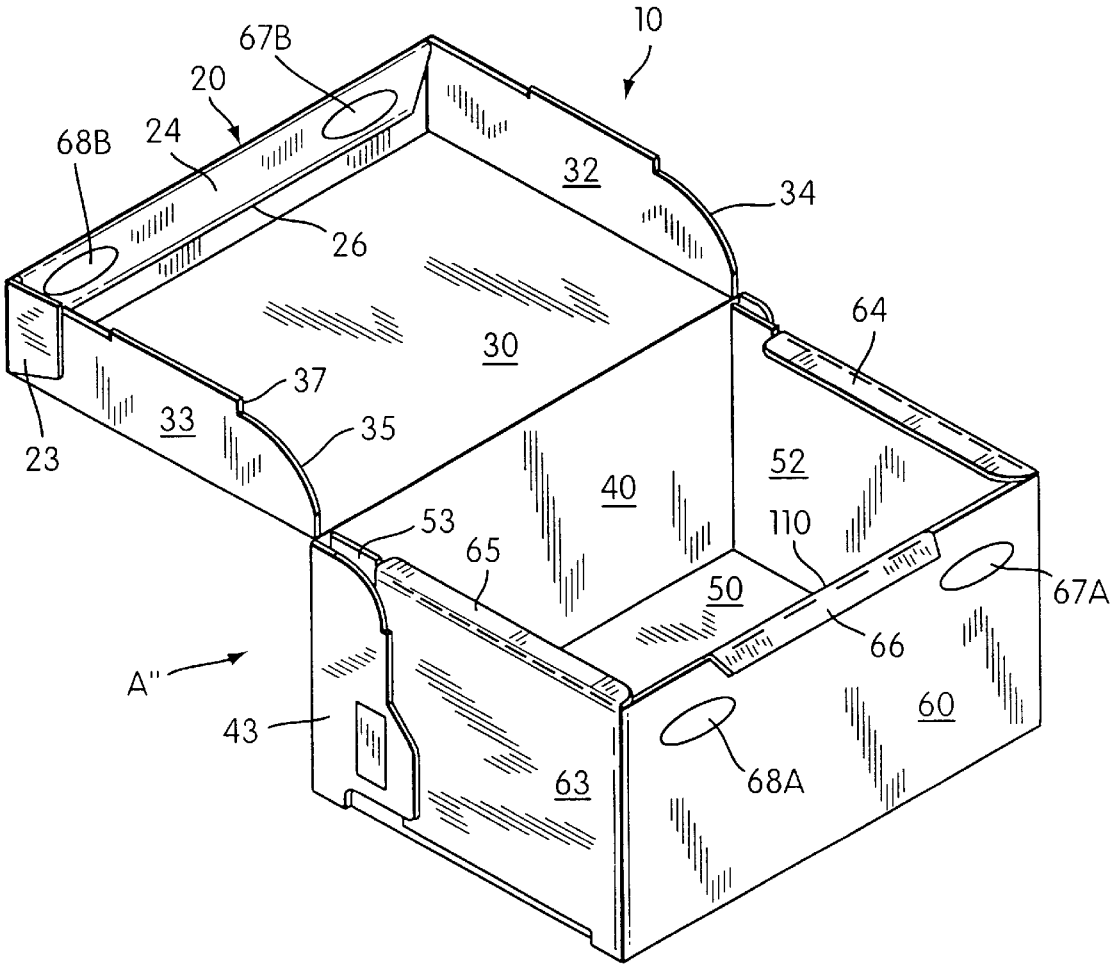
FIG. 7 shows carton A" with a flange lip and sealing surfaces in their sheared condition.

FIG. 7 shows sheared sealing surfaces 67B and 68B that are formed during opening. In this example, sheared sealing surfaces 67B and 68B are formed from a half layer thickness of paperboard substrate, but one skilled in the art could readily adapt alternative depths to this embodiment of the present invention.

Figure 6:
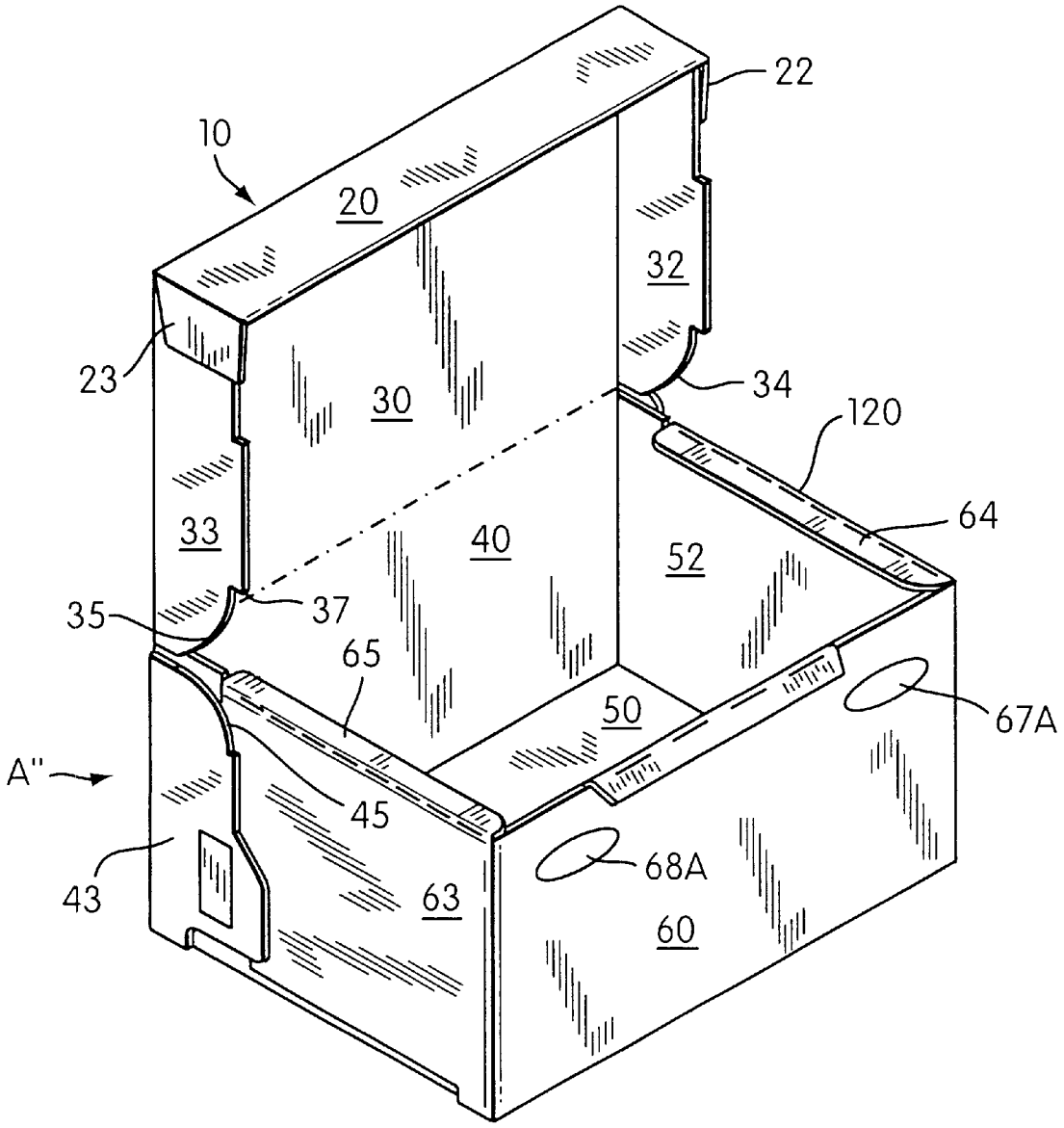
FIG. 6 displays carton A" with lid components described as top panel, cover panel and posts.

Lid 10 is shown in FIG. 6. It is comprised of cover panel 20 with posts 22 and 23, as well as top panel 30 with end flaps 32 and 33 and their smooth edges 34 and 35. FIG. 7 shows that lid 10 is twice the thickness of the paperboard where cover panel 20 is glued to the unfinished inner surface of in-folding flap 24. As shown in FIGS. 6 and 7, lid 10 has the "look" of more expensive circular lids for bucket-type barrels. Aesthetic appeal is created by hinged lid 10 which looks like a separate structure with smooth edges 34 and 35 accentuating the spatial separation from the ends of carton A".

Figure 8:
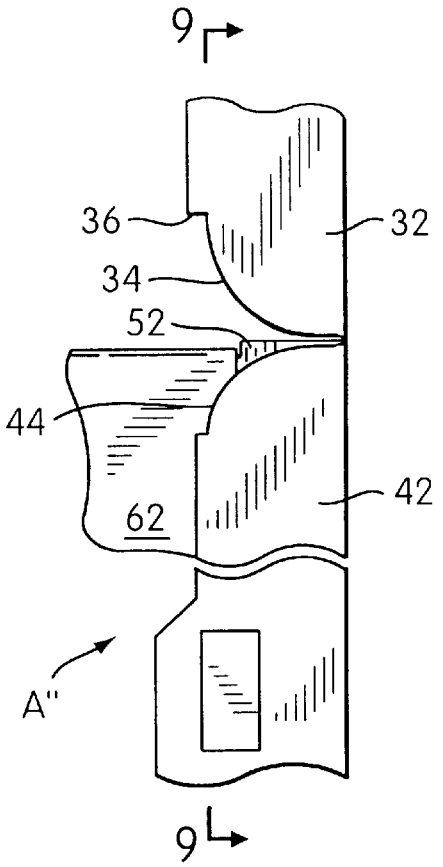
FIG. 8 is a fragmented, side elevational view emphasizing the relationship between the top panel and rear panel end flaps.
Figure 9:
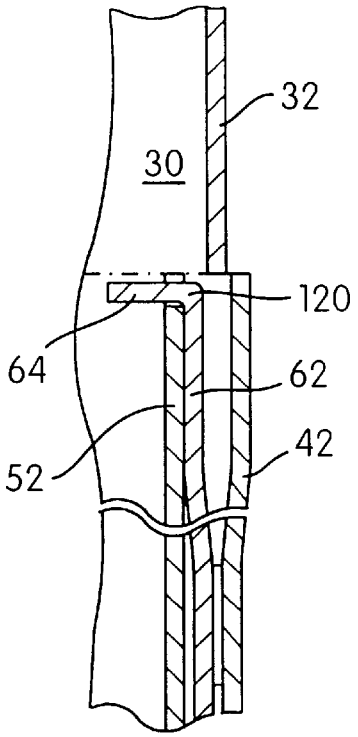
FIG. 9 is a cross-sectional view taken along line 9—9 in FIG. 8 showing the front panel end flap disposed between the bottom panel and rear panel end flaps.

FIG. 6 also shows the relationship between smooth edge 35 and smooth edge portion 45 at one end of open carton A". FIG. 8 is a fragmented side view showing the relationship between smooth edge 34 and smooth edge portion 44 at the opposite end of the opened carton. FIG. 9 is a cross-sectional view taken along line 9—9 in FIG. 8. It shows front panel end flap 62 disposed between bottom panel end flap 52 and rear panel end flap 42. Lip 64 is shown folded along joint line 120 and over bottom panel end flap 52. Top panel 30 is adapted to be lowered so that top panel end flap 32 fits into the pocket between the front panel end flap 62 and rear panel end flap 42 when lid 10 is reclosed.

FIG. 7 shows flange lip 66 connected to front panel 60 by means of joint line 110. Locking edge 26 on in-folding flap 24 is also displayed. As will be appreciated by skilled artisans, flange lip 66 retains its paperboard "memory" from initial manufacture until the seal of the carton is broken. This paperboard memory allows flange lip 66 to provide bias against the underlying outer surface of in-folding flap 24 and to lock against edge 26 on in-folding flap 24.

FIG. 10 shows a fragmented view of locking edge 26 engaged to flange lip 66 in phantom lines beneath cover panel 20. FIG. 11 shows the cross-sectional view of locking edge 26 on in-folding flap 24 substantially engaged to flange lip 66 which is connected to front panel 60. The combination of the bias provided by flange lip 66 against the underlying outer surface of in-folding flap 24 and the flange-type locking arrangement between locking edge 26 and flange lip 66 provide one embodiment of the reclosure mechanism of the present invention.

Figure 12:
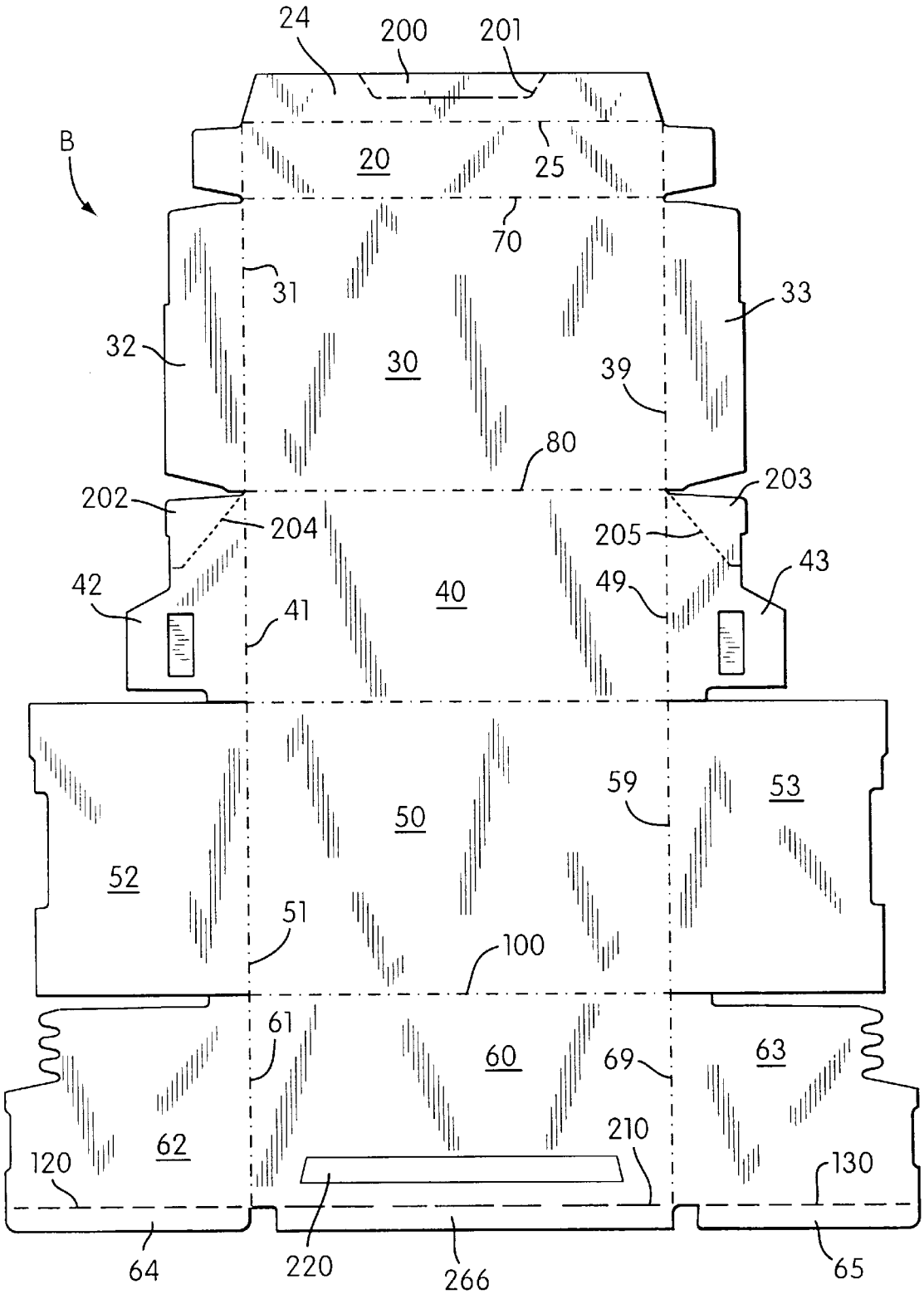
FIG. 12 shows blank B of the second embodiment featuring a releasable lock tab and its corresponding anchoring area.

The second embodiment of this invention will now be described in connection with FIGS. 12–19. Blank embodiment B shown in FIG. 12 comprises cover panel 20, top panel 30, rear panel 40, bottom panel 50 and front panel 60. Cover panel 20 is hingedly connected by score line 25 to in-folding flap 24. On the edge of in-folding flap 24 is releasable lock tab 200 which is formed by perforated border 201. FIG. 12 shows the outer print surface of blank B. Artwork displayed on this outer surface is ordinarily printed with acrylic pigments. Anchoring area 220 is patterned out of the artwork so that releasable lock tab 200 can be adhesively secured without interference from acrylic pigments.

In connection with blank embodiment B, rear panel end flaps 42 and 43 include breakaway tabs 202 and 203 which are formed in the flaps by perforation lines 204 and 205. Lip 266 is connected to front panel 60 by joint line 210, while front panel end flaps 62 and 63 are connected to lips 64 and 65 by joint lines 120 and 130.

Figure 13:
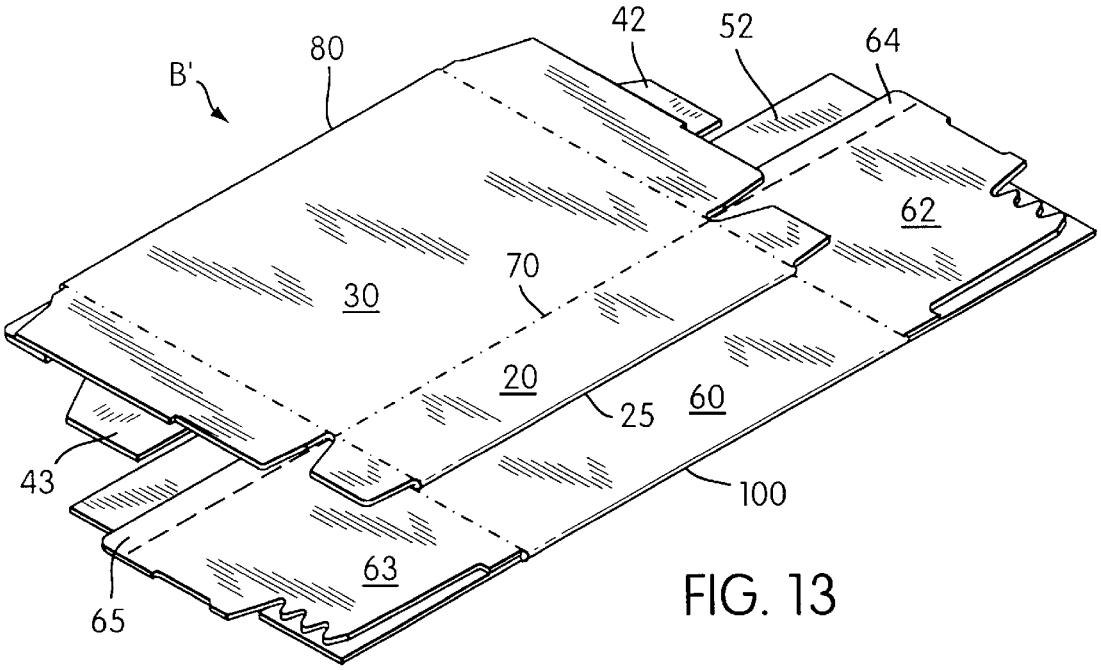
FIG. 13 is a top perspective view of sleeve B'.

In-folding flap 24 is bent at score line 25 and the unfinished inner surface of flap 24 is glued to the unfinished inner surface of cover panel 20, with care being taken to avoid adhesive on the unfinished inside surface of releasable lock tab 200. Sleeve B', shown in FIG. 13, is next formed by folding blank B at score lines 80 and 100 and placing adhesive substantially on the outside surface of lock tab 200 with care being taken to avoid adhesive on the remainder of the outer surface of flap 24, so that only releasable lock tab 200 is glued to the outer print side of front panel 60.

Figure 18:
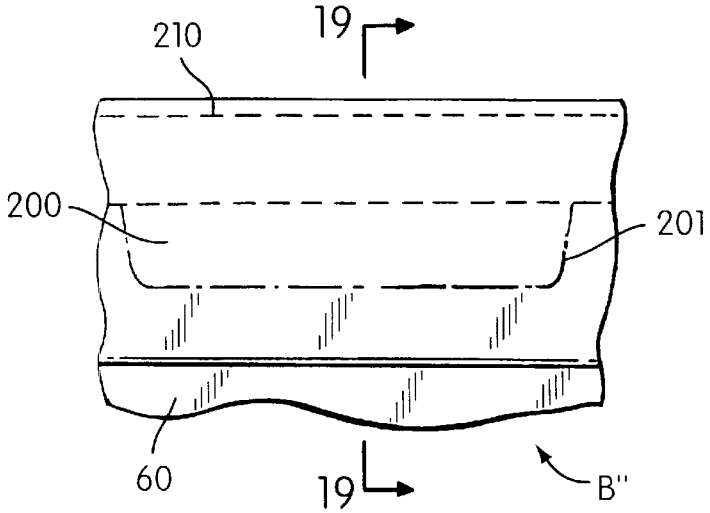
FIG. 18 is a fragmented front view showing the releasable lock tab anchored to the front panel.
Figure 19:
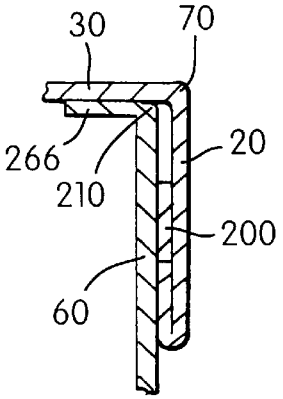
FIG. 19 is a cross-sectional view taken along line 19—19 in FIG. 18 showing the spatial orientation of the lock tab with reference to the cover panel and front panel.

FIG. 18 is a fragmented view showing releasable lock tab 200 (shown in phantom lines) adhered to front panel 60. FIG. 19 is a cross-sectional view taken along line 19—19 in FIG. 18. FIG. 19 shows releasable lock tab 200 situated between cover panel 20 and front panel 60 in assembled carton B". The inside surface of releasable lock tab 200 is free of adhesive and rests on the surface of cover panel 20, while the outside surface of releasable lock tab 200 is glued to the surface of front panel 60.

Figure 14:
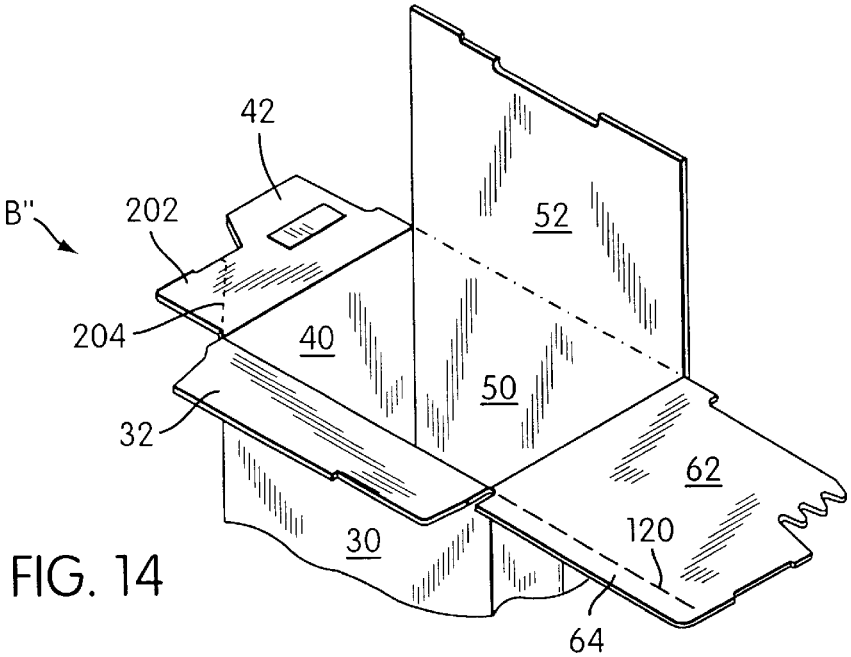
FIG. 14 is a fragmentary perspective view of one, open end of partially assembled carton B" ready for a form-filling operation.

Referring back to FIG. 12, lips 64, 65 and 266 are folded inward along joint lines 120, 210 and 130 during the form-filling operation. Lips 64 and 65 are then tucked in between the top panel and bottom panel end flaps, and lip 266 is tucked in between the top and front panels. For example, FIG. 14 shows one open end of partially formed carton B" ready for filling. The open end is closed by folding bottom panel end flap 52 first, then bending lip 64 inward along joint line 120 and next folding front panel end flap 62 over bottom panel end flap 52 while tucking lip 64 under top panel 30. Top panel end flap 32 is folded next and adhesive is deposited on the folded flaps. Rear panel end flap 42 is folded down last so that breakaway tab 202 is adhered to top panel end flap 32.

Figure 15:
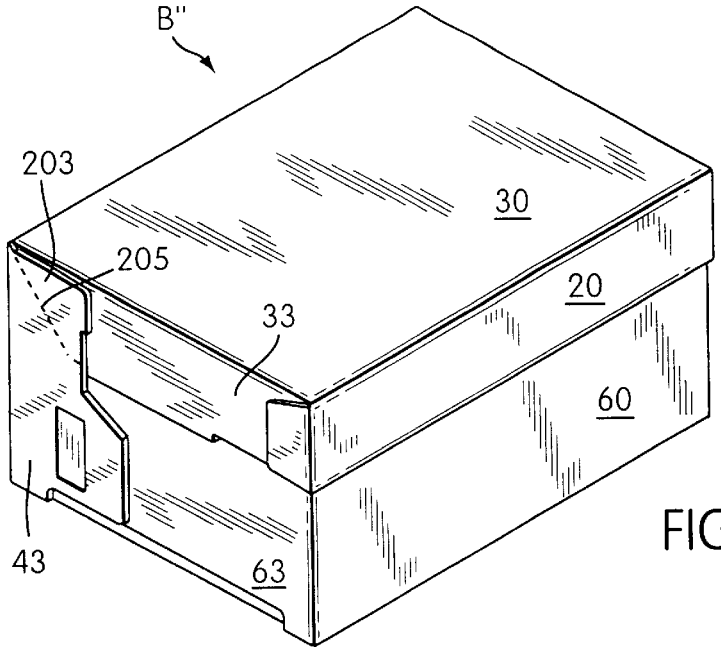
FIG. 15 is a top perspective view of carton B".
Figure 16:
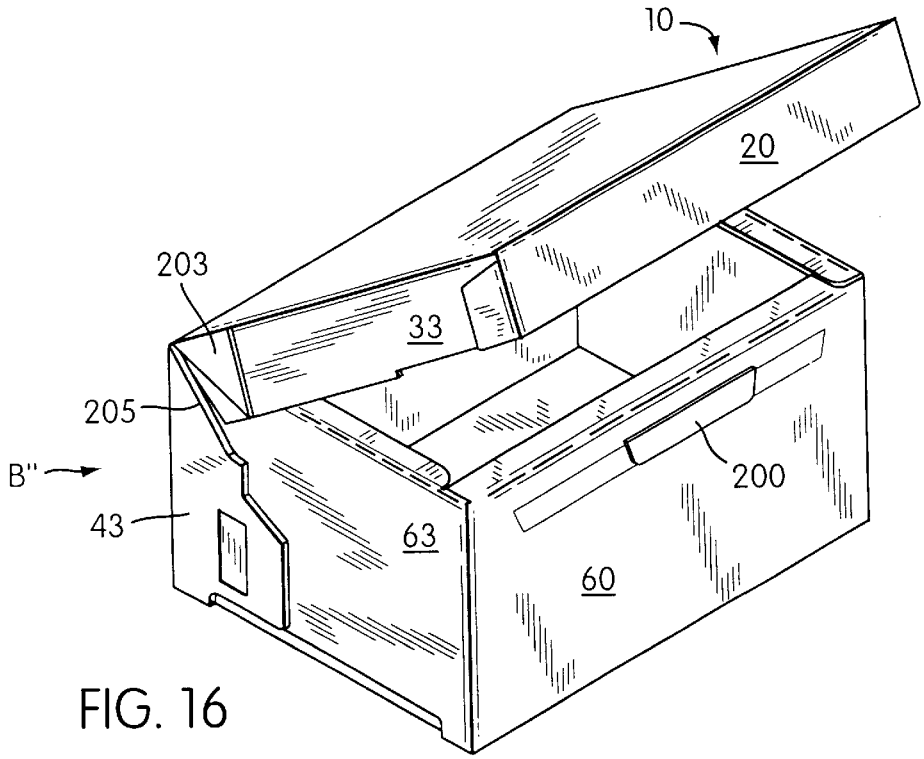
FIG. 16 illustrates carton B" shown in FIG. 15, with its seal broken and lid opened to reveal the releasable lock tab adhered to the front panel.

FIG. 15 shows carton B" with a fully sealed end wherein breakaway tab 203 of rear panel end flap 43 is shown adhered to top panel end flap 33. To open carton B", a consumer inserts two digits under cover panel 20 on either side of releasable lock tab 200 and lifts away lid 10. FIG. 16 shows carton B" with its seal broken and lid 10 in the open position. In this condition, releasable lock tab 200 is detached from in-folding flap 24 and adhered to front panel 60.

Figure 17:
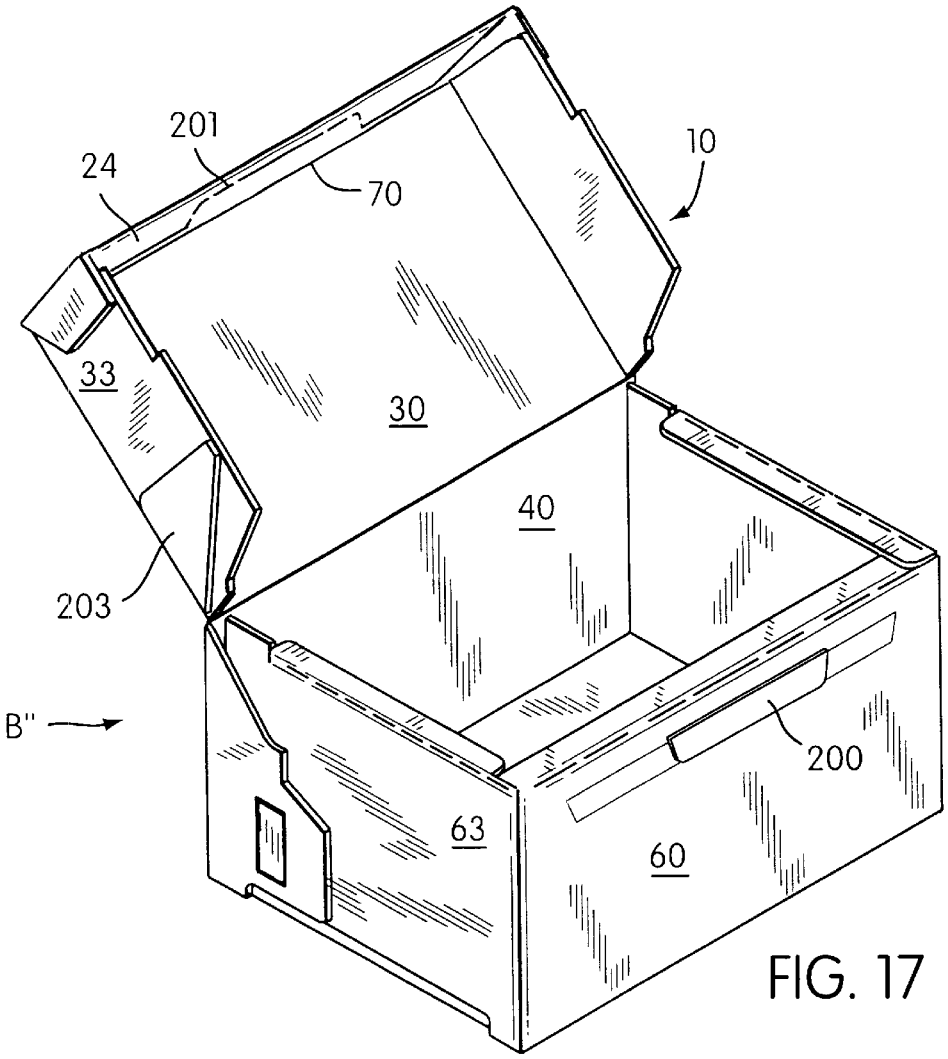
FIG. 17 shows carton B" featuring the lock tab released from its perforated border and adhered to the front panel.

FIG. 17 shows open lid 10 with perforated border 201 on in-folding flap 24 from which releasable lock tab 200 was detached as the seal of carton B" was broken. On carton B", perforated border 201 and tab 200 comprise interlocking means. When lid 10 is lowered for resealing, releasable lock tab 200 (now adhered to front panel 60) fits tightly into perforated border 201 which acts as a locking edge.

Figure 20:
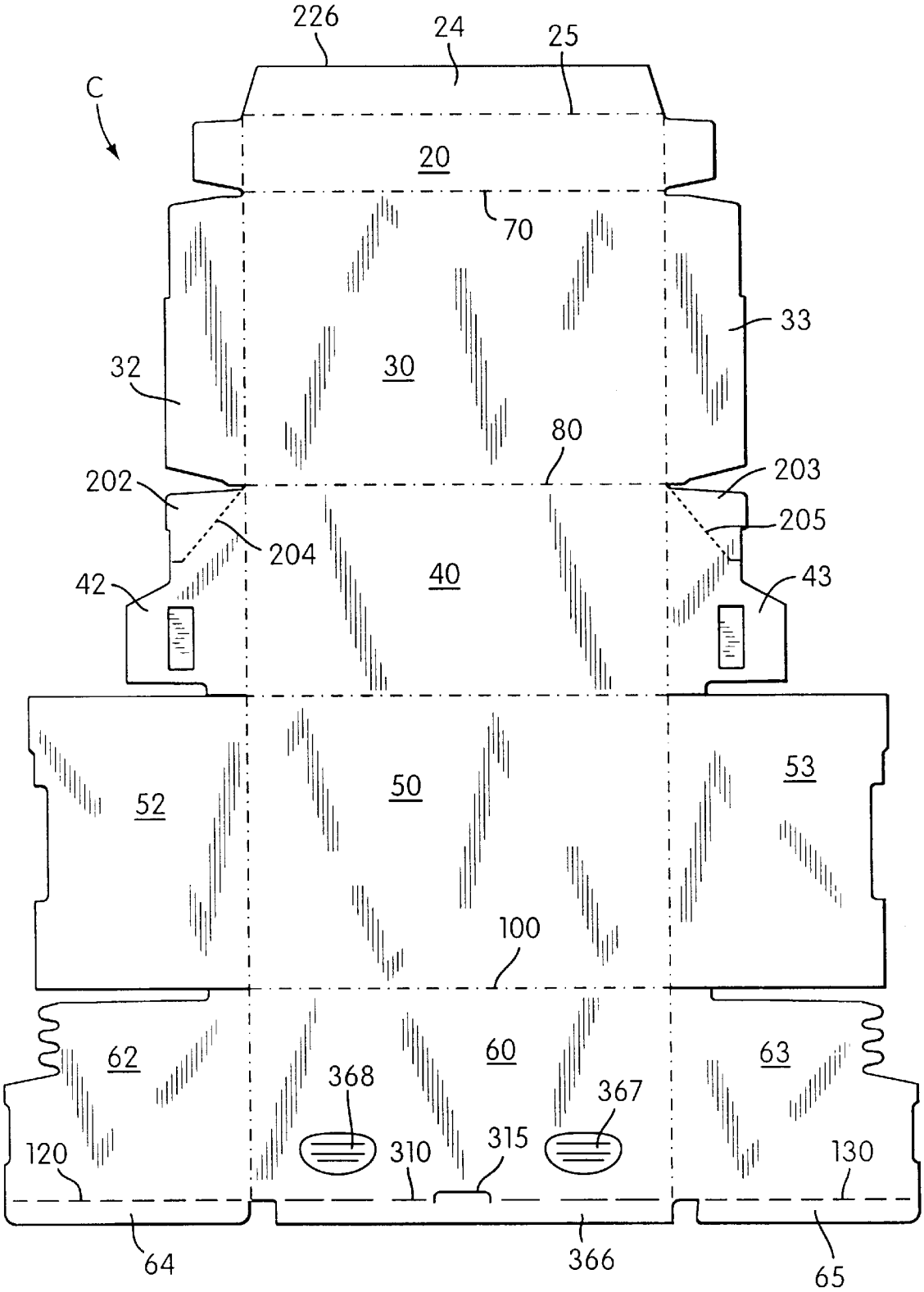
FIG. 20 shows blank C of the third embodiment featuring a male tab and its corresponding locking edge.

The third embodiment of this invention will now be described in connection with FIGS. 20–24. FIG. 20 shows blank embodiment C which has lip 366 connected to front panel 60 by joint line 310. Joint line 310 is shown as a die-cut perforation having a pattern which includes at least one male tab 315. The perforated pattern is cut through the entire thickness of paperboard with intervening areas of pre-selected lengths including, for example, uncut areas on either side of tab 315. Alternatively, the depth of the die-cut forming male tab 315 can be less than the entire paperboard thickness, preferably, between about one quarter to about three-quarters deep. One skilled in the art will also appreciate that joint line 310 can be formed as a solid score having within it a die-cut male tab of varying depth.

FIG. 20 also shows in-folding flap 24 of blank C terminating at locking edge 226 and front panel 60 having two die-cut sealing surfaces 367 and 368 on its outer print surface. Sealing surfaces 367 and 368 have a depth which is approximately half the thickness of paperboard blank C.

Blank C is folded, filled and assembled into carton C" in the same manner described for blank B and corresponding carton B"—except for the alignment of tab 315 with locking edge 226 and the gluing of sealing surfaces 367 and 368 during sleeve formation. In-folding flap 24 of blank C is bent at score line 25 and the unfinished inner surface of in-folding flap 24 is glued to the unfinished inner surface of cover panel 20. Intermediate sleeve C' is next formed by folding blank C at score lines 80 and 100 and placing adhesive on sealing surfaces 367 and 368 while avoiding adhesive deposits on the remainder of the outer surface of front panel 60, so that only sealing surfaces 367 and 368 are glued to the underlying outer surface of in-folding flap 24.

Figure 23:
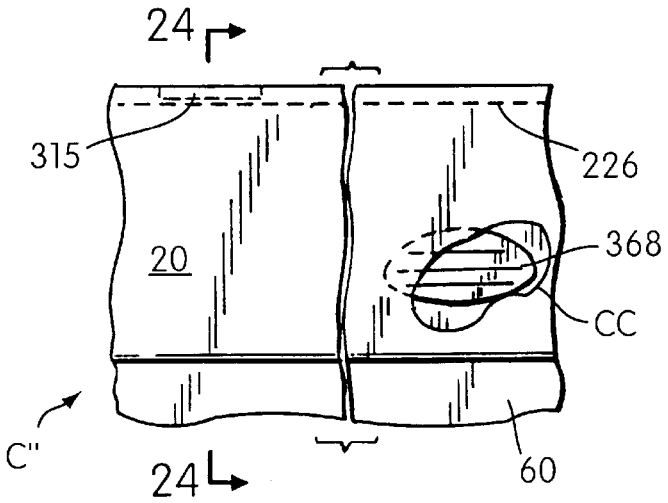
FIG. 23 is a front fragmented view showing the male tab engaged to the locking edge which are both shown in phantom lines.
Figure 24:
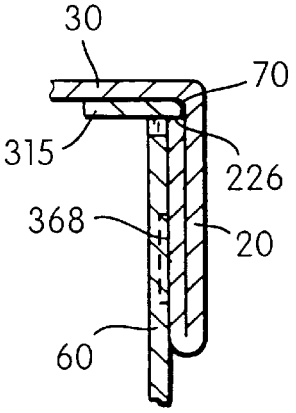
FIG. 24 is a cross-sectional view taken along line 24—24 in FIG. 23 showing the male tab engaged to the locking edge.

FIG. 23 is a fragmented view showing cover panel 20 adhered to front panel 60 on carton C". It shows the spatial relationship between sealing surface 368 (shown partially in phantom lines with a portion displayed by cut-away view CC through cover panel 20) and male tab 315 (shown with phantom lines). FIG. 24 is a cross-sectional view taken along line 24—24 in FIG. 23. It emphasizes the engagement of male tab 315 to locking edge 226.

Figure 21:
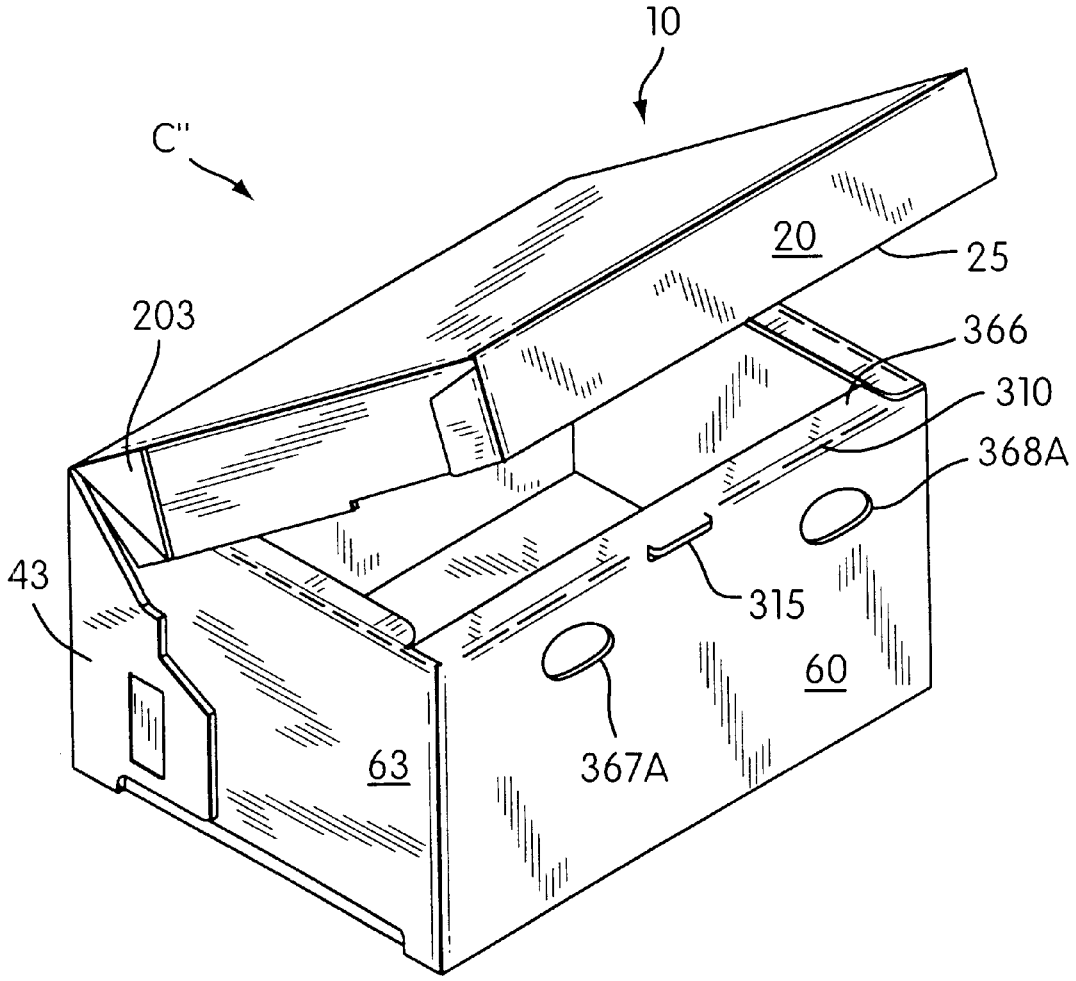
FIG. 21 shows carton C" with its seal broken and lid opened to display the male tab of the third embodiment as well as sheared sealing surfaces disposed on the front panel.
Figure 22:
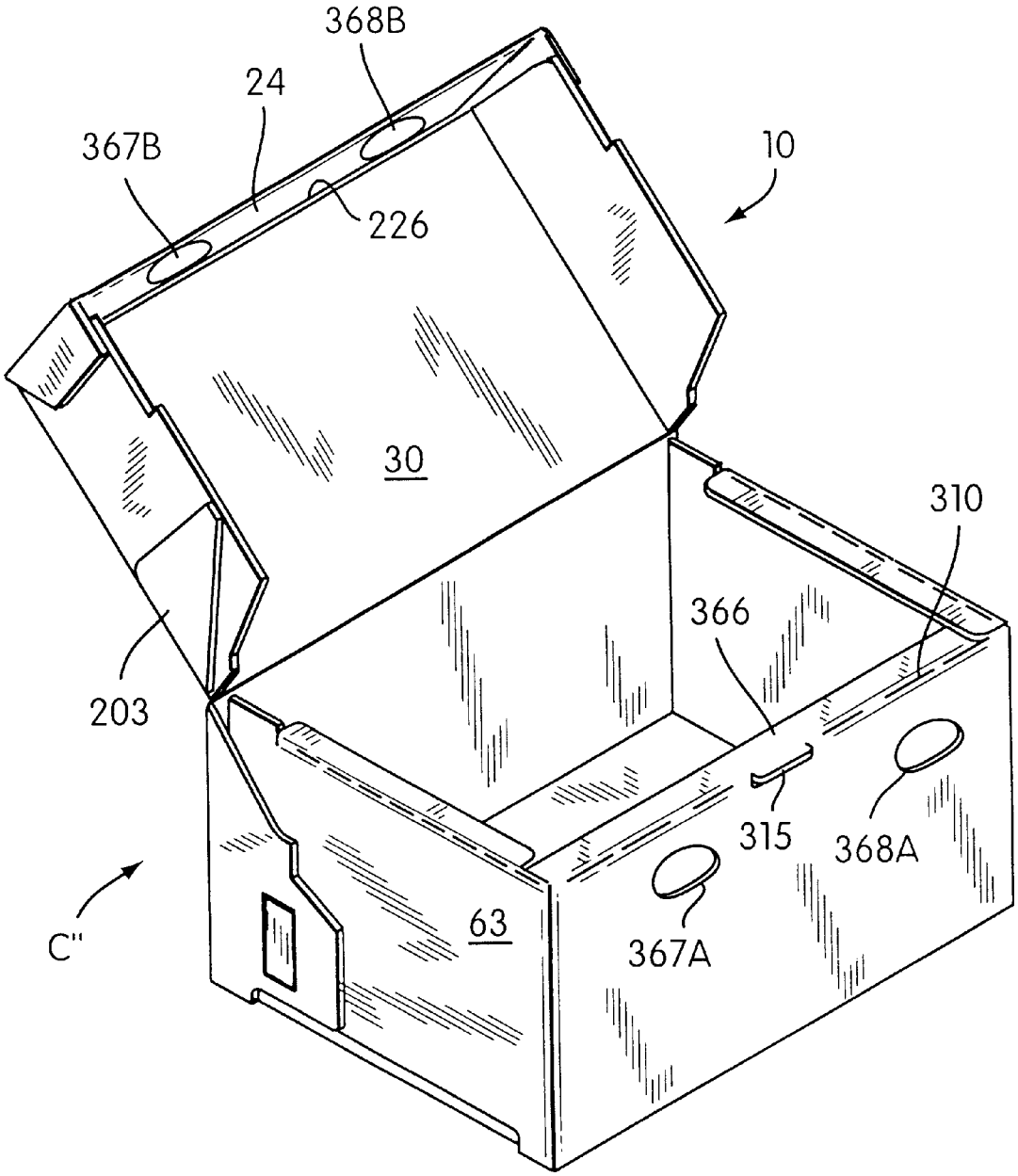
FIG. 22 shows carton C" with its seal broken and lid opened to display the male tab of the third embodiment as well as sheared sealing surfaces disposed on the front panel and underlying outer surface of the in-folding flap.

FIG. 21 shows carton C" with its seal broken and lid 10 open. Lip 366 is connected to front panel 60 by bent, joint line 310. Male tab 315 is perpendicular to the plane of front panel 60 and positioned to function as a locking tab when lid 10 is lowered for resealing. To break the seal of carton C", the end-user inserts a digit under cover panel 20 and lifts it away from front panel 60. As previously explained, this action shears away half a layer of paperboard along die-cuts forming sealing surfaces 367 and 368, leaving behind sheared sealing surfaces 367A and 368A which are half the thickness of the paperboard stock. FIG. 22 shows sheared sealing surfaces 367B and 368B now adhered to in-folding flap 24. By way of illustration, they are formed from the other half thickness of paperboard.

FIG. 24 shows a cross-sectional view of locking edge 226 engaged to male tab 315 under top panel 30. The space between locking edge 226 and top panel 30 provides a slot which is occupied by male tab 315 in the locked position. The bias provided by tab 315 against locking edge 226 as lid 10 is opened and closed provides yet another embodiment of the locking/reseal mechanism of the present invention.

It is not necessary to center male tab 315 along joint line 310. Nor is this embodiment limited to a single male tab. Similar benefits can be achieved using a plurality of male tabs which engage locking edge 226 at pre-selected locations.

Figure 25:
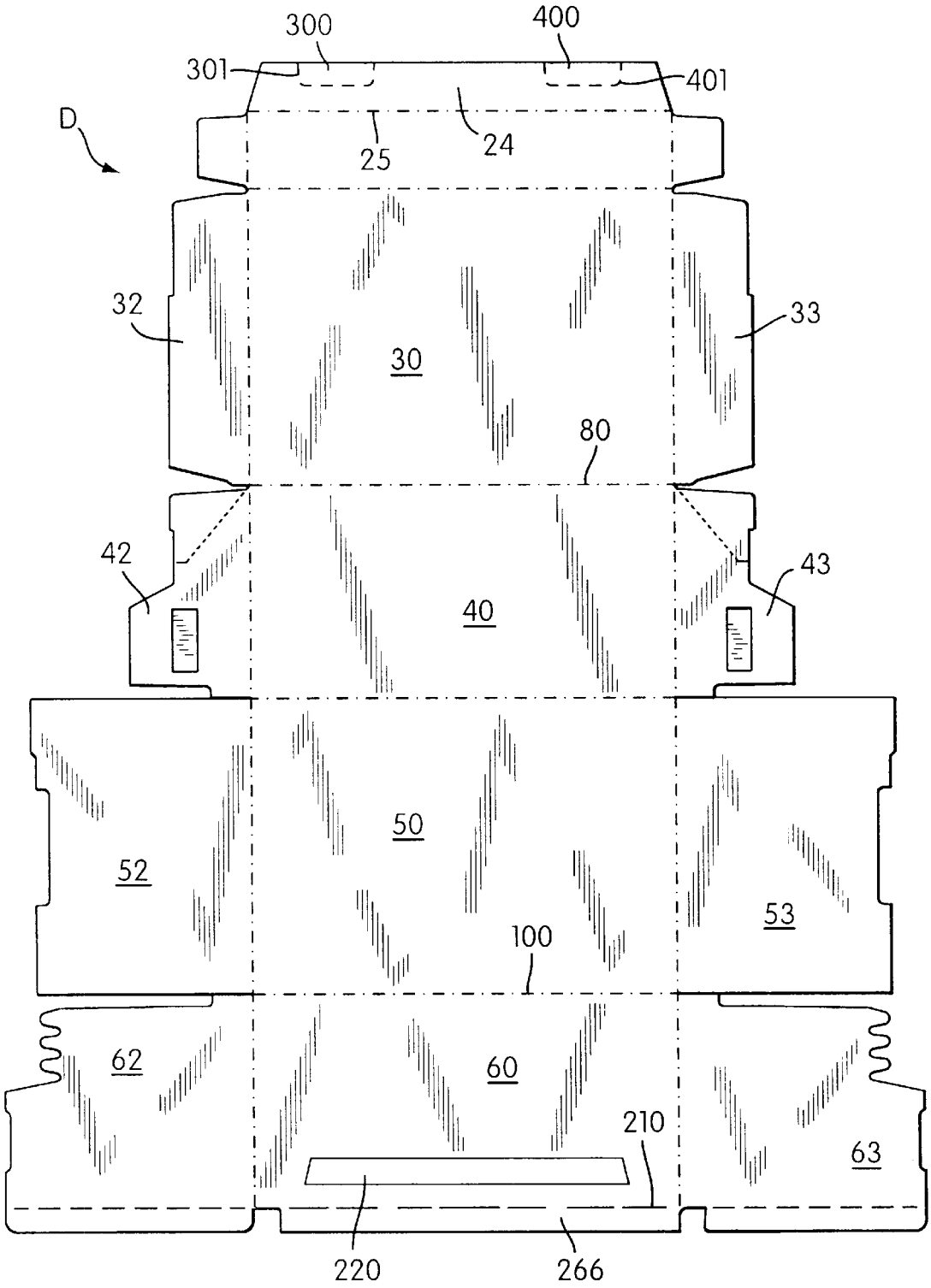
FIG. 25 shows blank D of the fourth embodiment featuring a plurality of releasable lock tabs and their corresponding anchoring area.
Figure 26:
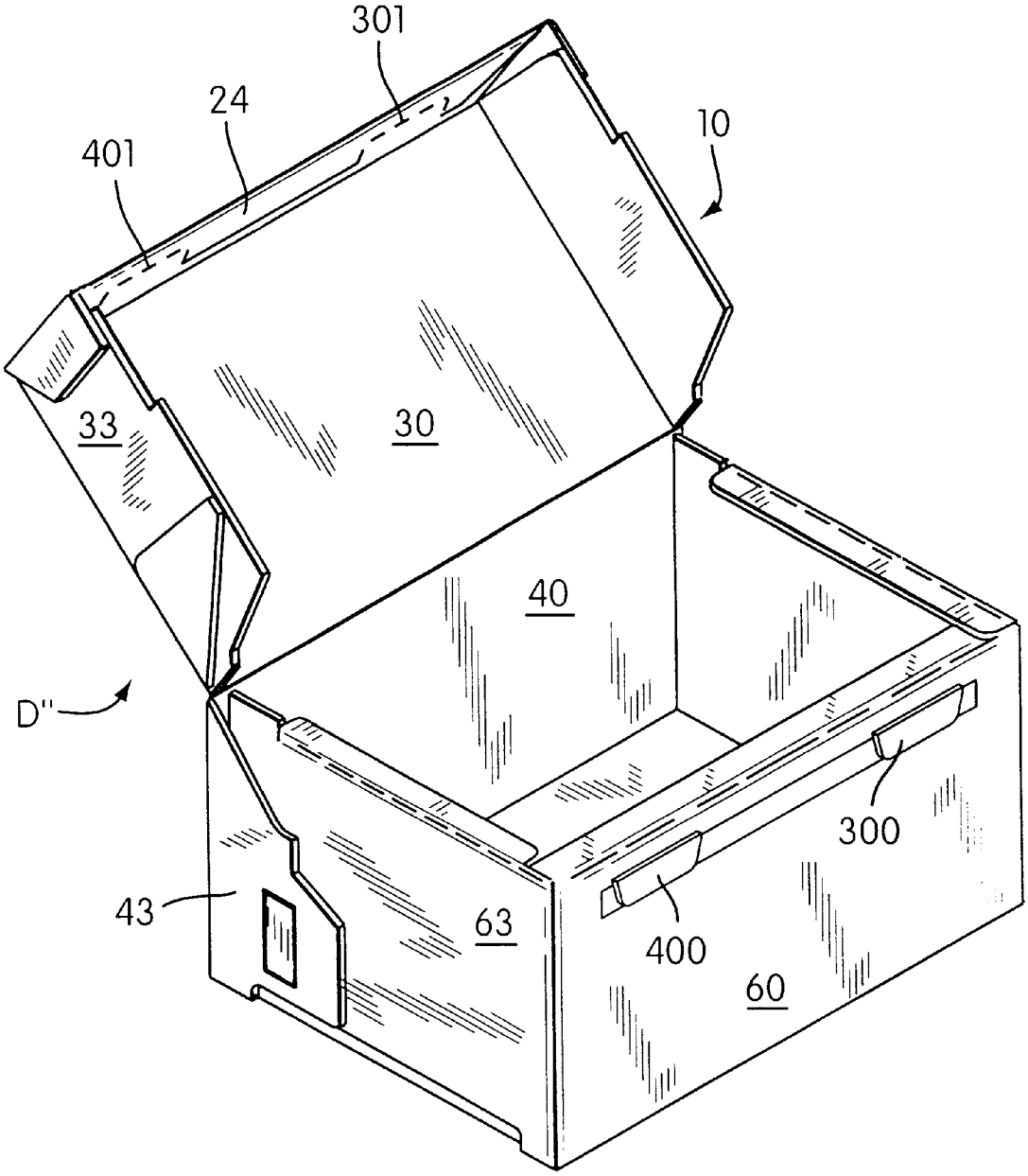
FIG. 26 shows carton D" featuring the lock tabs released from their perforated borders and adhered to the front panel.

The fourth embodiment of this invention will now be described in connection with FIGS. 25–28. Blank embodiment D shown in FIG. 25 is similar to embodiment B illustrated by FIG. 12, with the exception of having two releasable lock tabs 300 and 400 on the edge of in-folding flap 24. Releasable lock tabs 300 and 400 are formed by perforated borders 301 and 401, respectively. In-folding flap 24 is bent at score line 25 and the unfinished inner surface of in-folding flap 24 is glued to the unfinished inner surface of cover panel 20, with care being taken to avoid adhesive deposits on the unfinished inner surfaces of releasable lock tabs 300 and 400.

A sleeve is next formed by folding blank D at score lines 80 and 100 and placing adhesive on the outside surfaces of releasable lock tabs 300 and 400 while avoiding adhesive on the remainder of the underlying outer surface of in-folding flap 24, so that only releasable lock tabs 300 and 400 are glued to the outer print surface of front panel 60.

Figure 27:
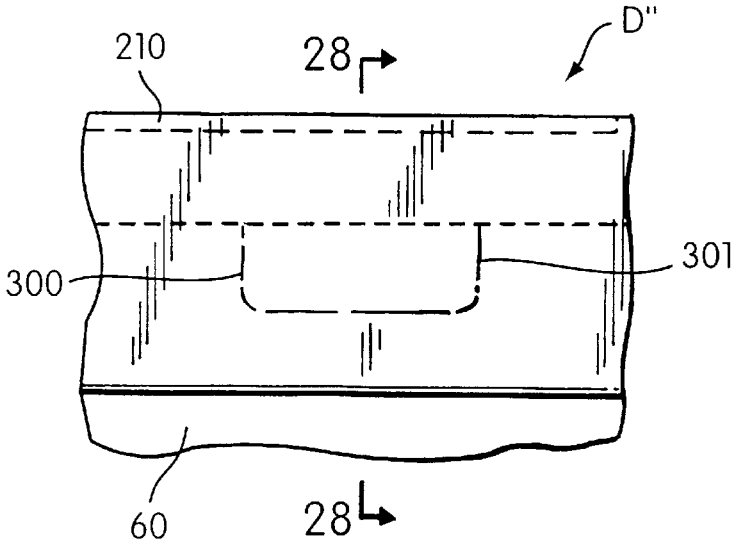
FIG. 27 is a fragmented front view showing a releasable lock tab of the fourth embodiment adhered to the front panel.
Figure 28:
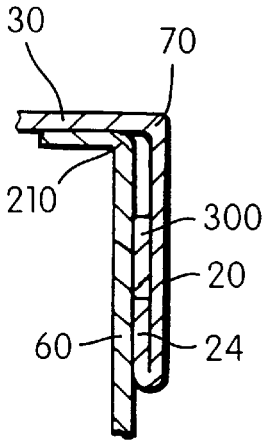
FIG. 28 is a cross-sectional view taken along line 28—28 in FIG. 27 showing the spatial orientation of a lock tab of the fourth embodiment with reference to the cover panel and front panel.

FIG. 27 is a fragmented view showing releasable lock tab 300 (in phantom lines) adhered to front panel 60. FIG. 28 is a cross-sectional view taken along line 28—28 in FIG. 27. FIG. 28 shows releasable lock tab 300 situated between cover panel 20 and front panel 60 in an assembled carton. The inside surface of releasable lock tab 300 is free of glue and rests on the surface of cover panel 20, while the outside surface of releasable lock tab 300 is secured to the surface of front panel 60.

To open carton D", a consumer inserts a digit under cover panel 20 on either side of releasable lock tabs 300 and/or 400. Lid 10 is then lifted away from the receptacle portion or body of the carton. FIG. 22 shows carton D" with its seal broken, lid 10 in the open position with releasable lock tabs 300 and 400 detached from in-folding flap 24 and now adhered to front panel 60. Open lid 10 has perforated borders 301 and 401 on in-folding flap 24 from which releasable lock tabs 300 and 400 were detached as the seal of carton D" was broken. With respect to carton D", perforated borders 301 and 401, in conjunction with releasable lock tabs 300 and 400, comprise the interlocking means. When lid 10 is lowered for resealing, releasable lock tabs 300 and 400 cooperate with perforated borders 301 and 401 to effect a seal.

Figure 29:
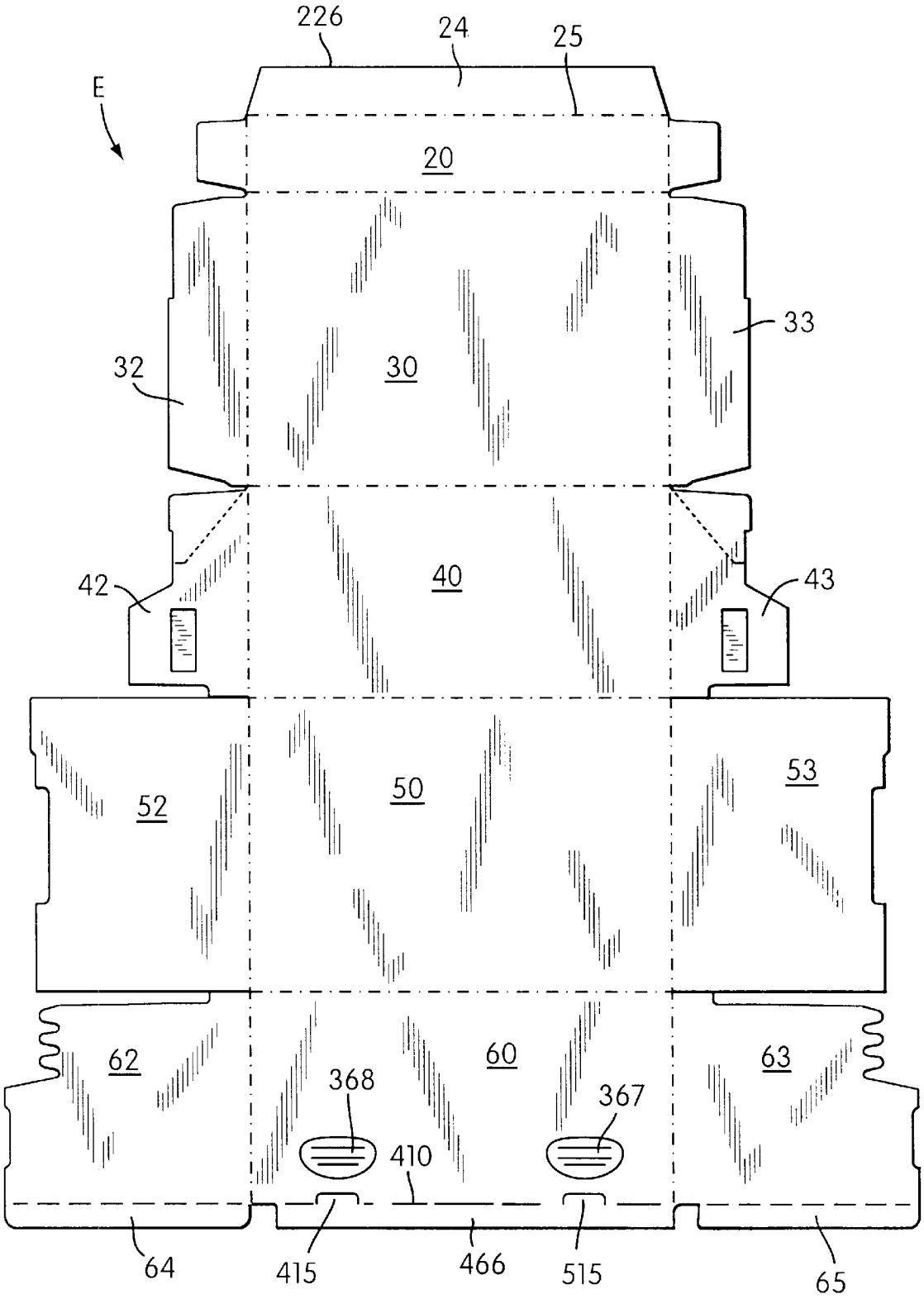
FIG. 29 shows blank E of the fifth embodiment featuring a plurality of male tabs and their corresponding locking edge.

The fifth embodiment of this invention will now be described in connection with FIGS. 29–31. Blank embodiment E shown in FIG. 29 is similar to embodiment C illustrated by FIG. 20, except for the plurality of male tabs 415 and 515. FIG. 29 shows blank embodiment E with lip 466 connected to front panel 60 by joint line 410. Line 410 is shown as a die-cut perforation having a pattern which includes at least one male tab.

In FIG. 29, joint line 410 is cut through the entire thickness of paperboard with intervening areas of preselected length (for example, one-eighth of an inch) between cuts. Male tabs 415 and 515 can be formed by die-cuts through the paperboard or by shallow incisions ranging from about one-quarter to about three-quarters of the paperboard thickness.

FIG. 29 also shows in-folding flap 24 of blank E terminating at locking edge 226. Front panel 60 is shown having two die-cut sealing surfaces 367 and 368 on its outer print surface. Sealing surfaces 367 and 368 have depths which are approximately half the thickness of paperboard blank E. The folding sequence of blank E is identical to that of blank C—except for the alignment of male tabs 415 and 515 with locking edge 226.

Figure 30:
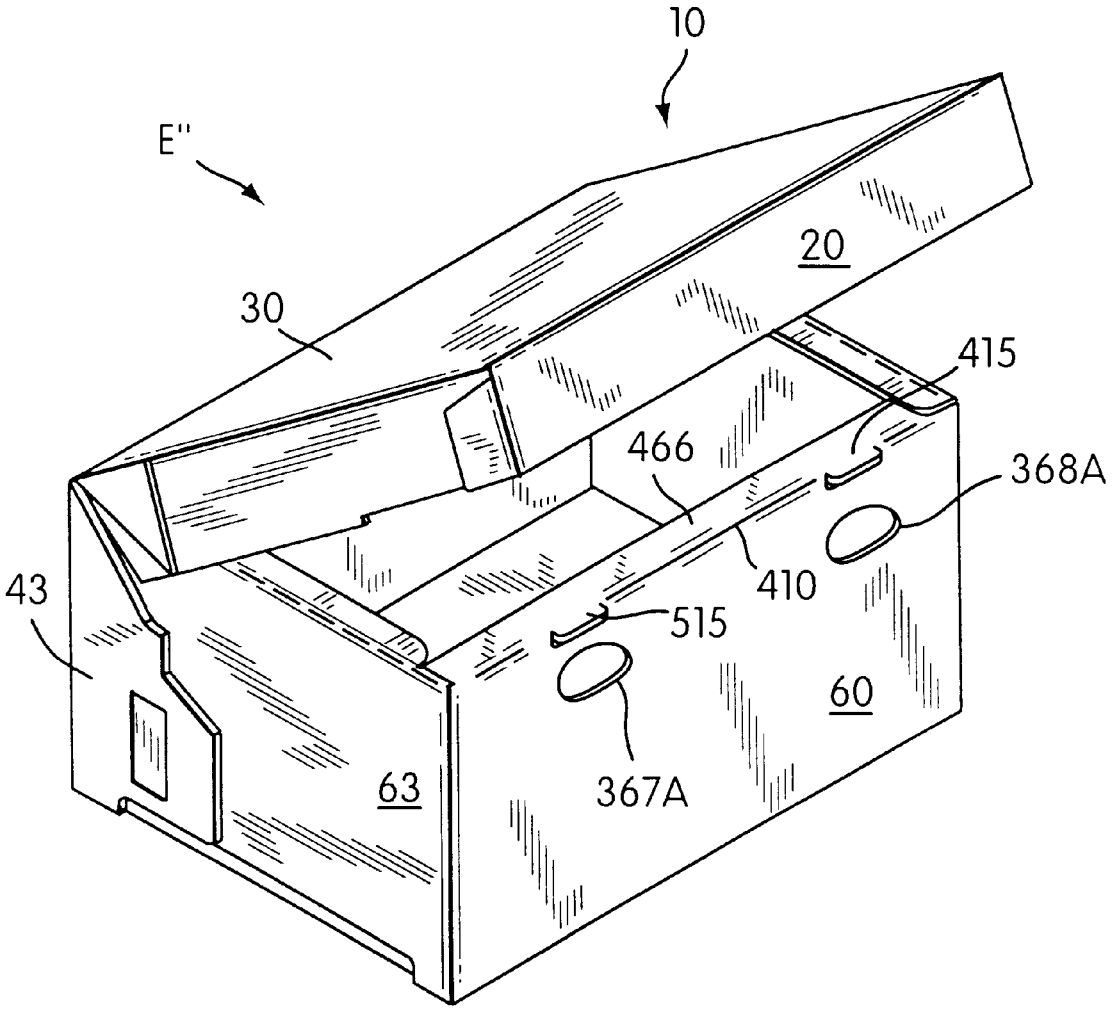
FIG. 30 illustrates carton E" with its seal broken and lid opened to display the male tabs of the fifth embodiment as well as sheared sealing surfaces disposed on the front panel.
Figure 31:
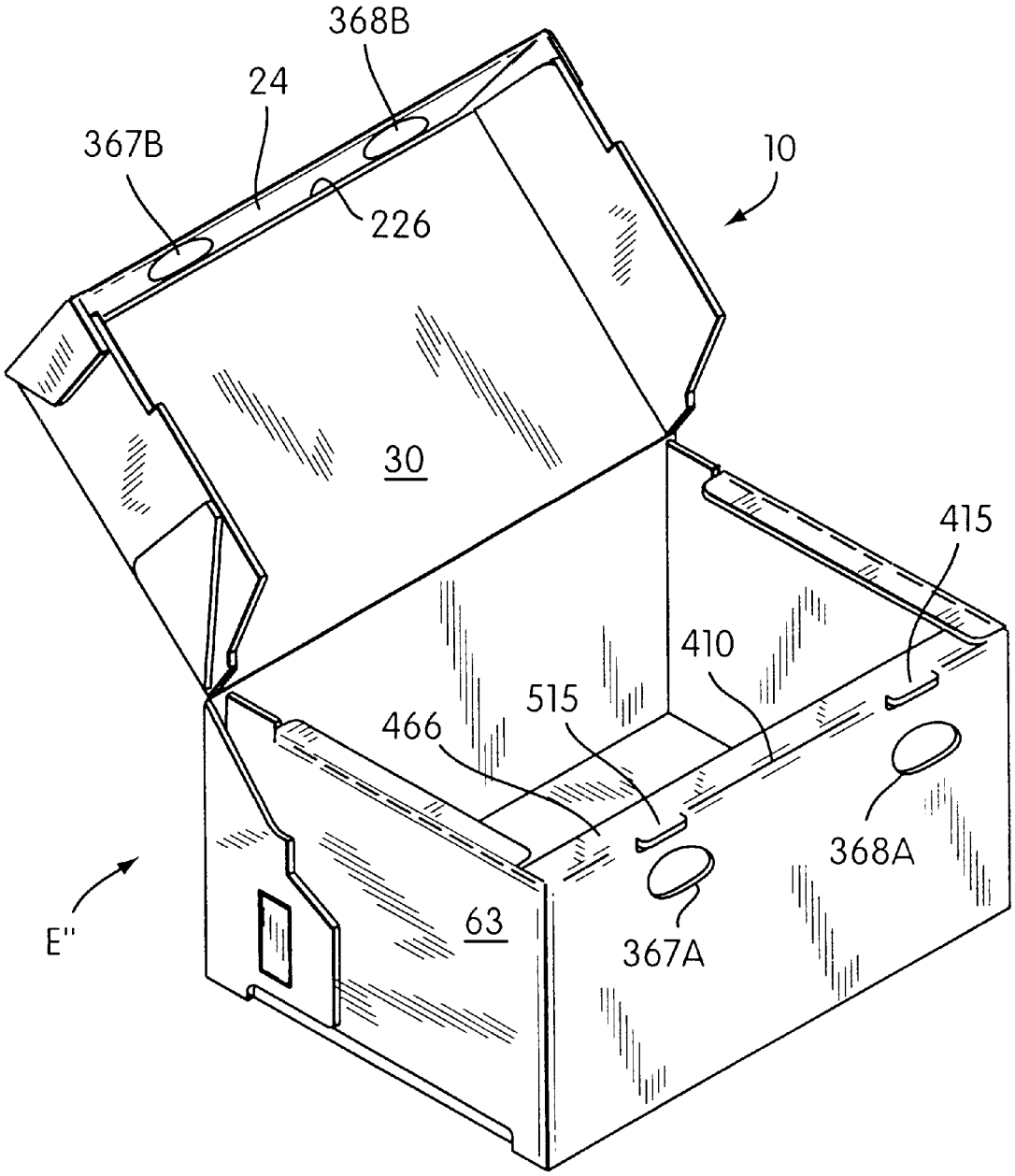
FIG. 31 illustrates carton E" with its seal broken and lid opened to display the male tabs of the fifth embodiment as well as sheared sealing surfaces disposed on the front panel and underlying outer surface of the in-folding flap.

FIG. 30 shows carton E" with its seal broken and lid 10 open. Lip 466 is connected to front panel 60 by means of bent joint line 410. In this configuration, male tabs 415 and 515 are perpendicular to the plane of front panel 60. They are positioned to function as locking tabs when lid 10 is brought back down for resealing. As on carton C", a space between locking edge 226 and top panel 30 provides a slot for male tabs 415 and 515 in the locked position. As lid 10 is opened and closed, the bias provided by male tabs 415 and 515 against locking edge 226 constitutes another embodiment of the locking mechanism of the present invention. For additional detail, FIG. 31 shows sheared sealing surfaces 367B and 368B attached to in-folding flap 24. As previously described, they are sheared to a half layer thickness of paperboard when the carton is opened.

Figure 32:
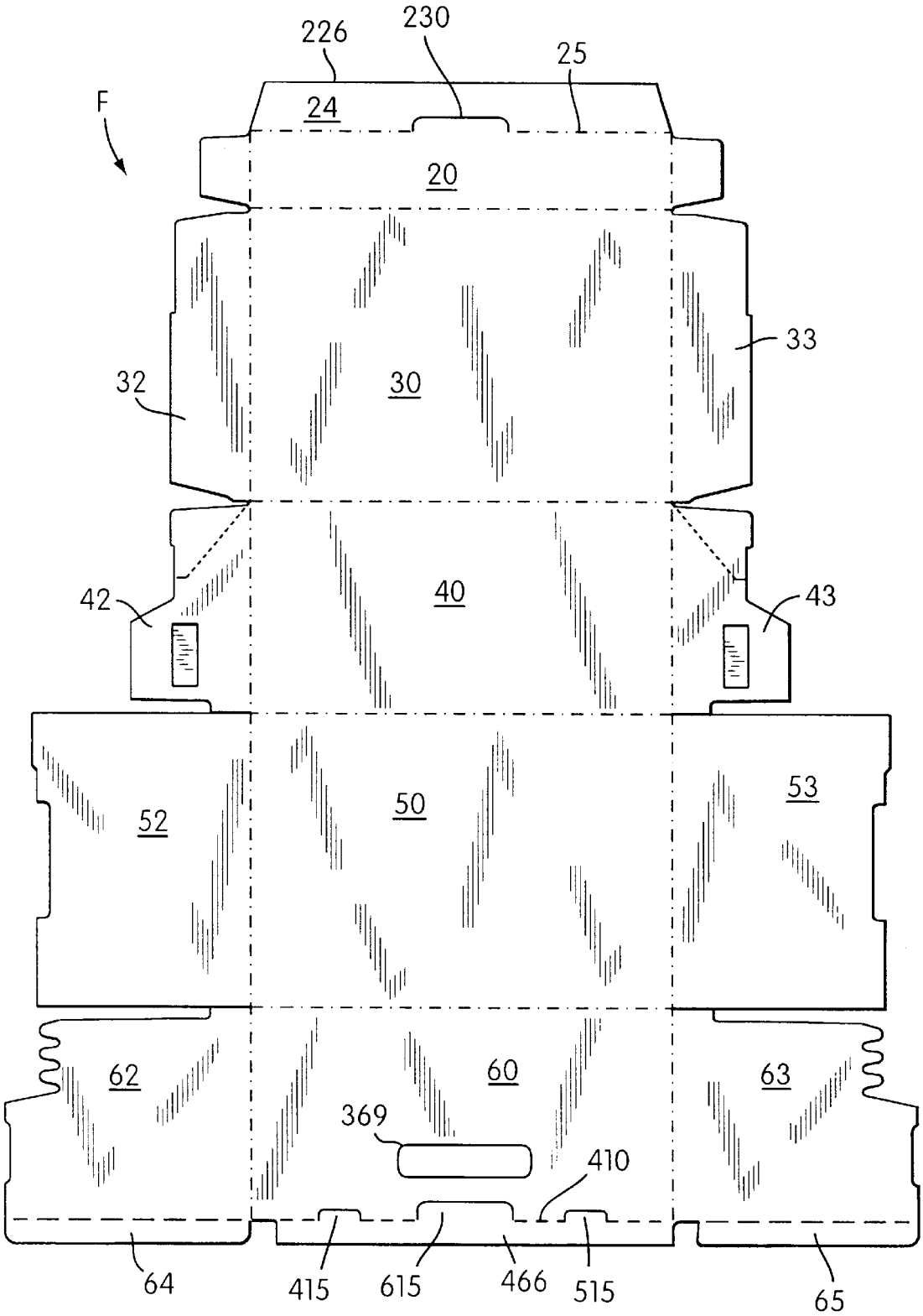
FIG. 32 shows blank F of the sixth embodiment featuring a die-cut appendage formed in the score line disposed between the cover panel and in-folding flap. The male tabs and locking edge of the fifth embodiment are also shown.

The sixth embodiment of this invention will now be described in connection with FIGS. 32–34. Referring to FIG. 32, foldable blank F is shown with die-cut appendage 230 formed in score line 25 connecting in-folding flap 24 to cover panel 20. On blank F, in-folding flap 24 also terminates at locking edge 226. Male tabs 415, 515 and 615 are die-cuts in joint line 410 which connects lip 466 to front panel 60. Line 410 is shown in FIG. 32 as a die-cut perforation having a pattern which includes the male tabs. The depth of the die-cuts forming male tabs 415, 515 and 615 can be less than the entire paperboard thickness, preferably between about one quarter to about three-quarters deep. One skilled in the art will also appreciate that joint line 410 can be formed as a solid score having within it die-cut male tabs of varying depth.

FIG. 32 also shows front panel 60 having die-cut sealing surface 369 on its outer print surface. Sealing surface 369 has a depth which is approximately half the thickness of paperboard blank F. During sleeve assembly, the underlying outer surface of in-folding flap 24 is glued to sealing surface 369 on front panel 60.

Figure 33:
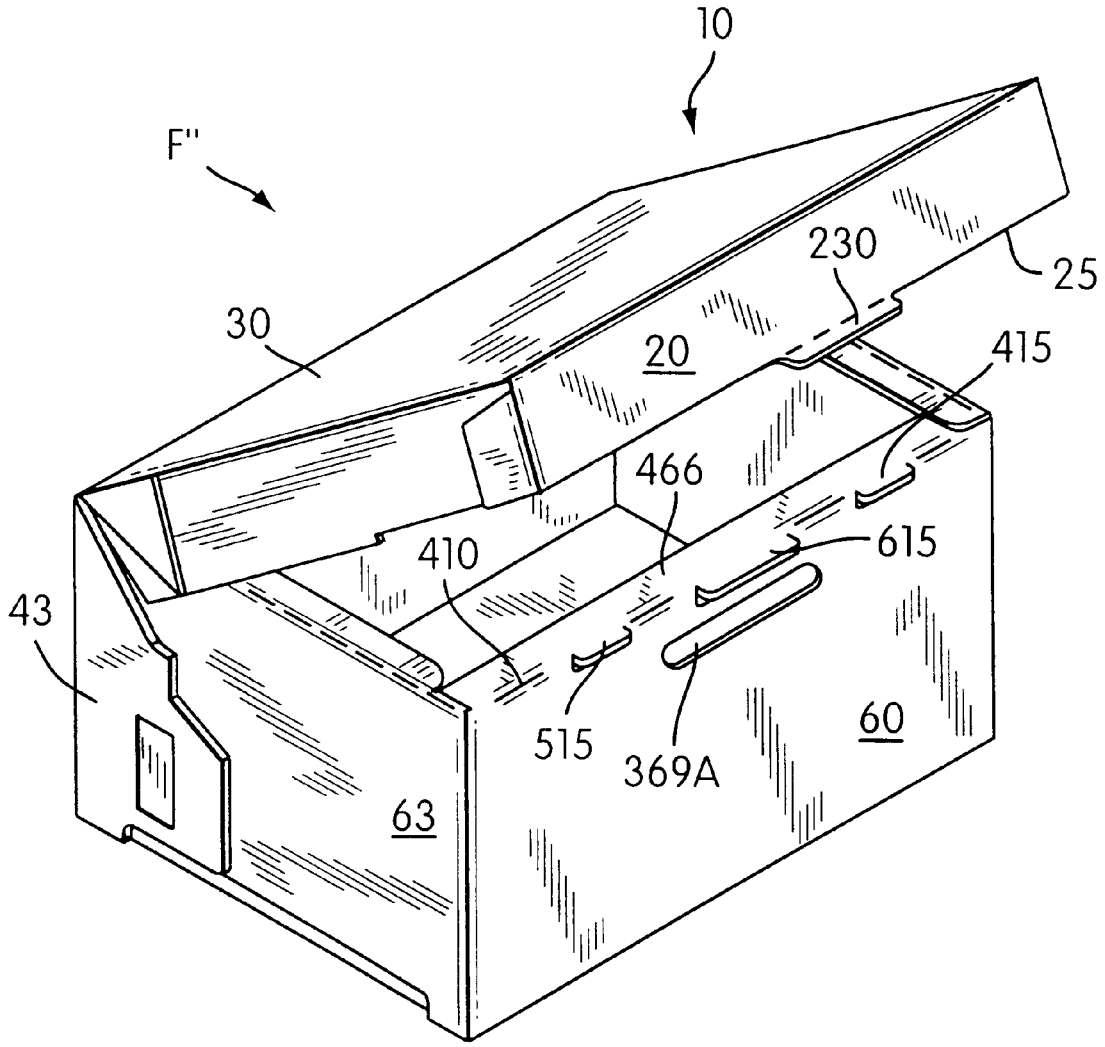
FIG. 33 illustrates carton F" with its seal broken and lid opened to display the die-cut appendage as well as the male tabs of the fifth embodiment.
Figure 34:
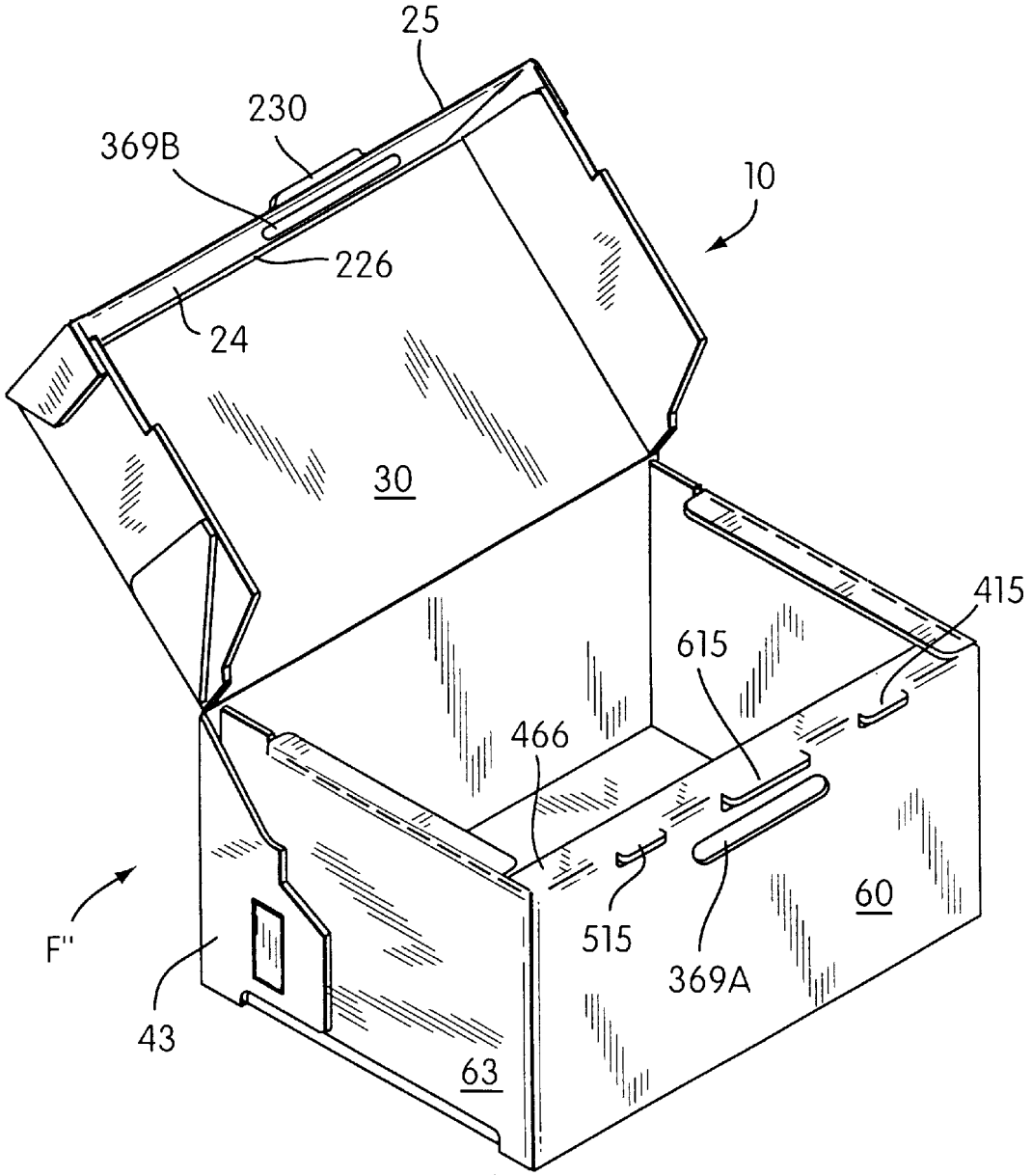
FIG. 34 illustrates carton F" with its seal broken and lid opened to display the die-cut appendage as well as a sheared sealing surface disposed on the underlying outer surface of the in-folding flap.

Referring to FIG. 33, carton F" is shown with its seal broken and lid 10 open. Lip 466 is connected to front panel 60 by joint line 410. In this configuration, male tabs 415, 515 and 615 are perpendicular to the plane of front panel 60. They are positioned to function as reclosure means when lid 10 is lowered. A space between locking edge 226 (not shown in FIG. 33) and top panel 30 provides a slot for male tabs 415, 515 and 615 in the closed position. As lid 10 is opened and closed, the bias provided by male tabs 415, 515 and 615 against locking edge 226 constitutes another reclosure embodiment of the present invention.

FIG. 33 also shows appendage 230 formed in score line 25 connecting in-folding flap 24 (not shown) to cover panel 20 in carton F". Appendage 230 is shown tangential to the plane of cover panel 20. It is used by a consumer to lift lid 10 as an aid to breaking the seal of carton F", leaving behind sheared sealing surface 369A having a depth approximately half the thickness of the paperboard. FIG. 34 shows sheared sealing surface 369B now attached to in-folding flap 24. As previously explained, sheared sealing surface 369B has a depth which approximates half the paperboard thickness.

Various modifications and alterations to the present invention may be appreciated based on a review of this disclosure. These changes and additions are intended to be within the scope and spirit of this invention as defined by the following claims.

What is claimed is:

1. A foldable blank for assembling a carton, said blank comprising:

(a) cover, top, rear, bottom and front panels hingedly connected in the order named, said cover, top, rear, bottom and front panels each having left and right ends;

(b) an in-folding flap hingedly connected to said cover panel, said in-folding flap having an inner surface, an outer surface and a locking edge;

(c) left and right top panel end flaps hingedly connected to said left and right ends of said top panel, said left top panel end flap having a first smooth edge terminating in a first relief notch, said right top panel end flap having a second smooth edge terminating in a second relief notch;

(d) left and right rear panel end flaps hingedly connected to said left and right ends of said rear panel, said left rear panel end flap having a third smooth edge, said right rear panel end flap having a fourth smooth edge;

(e) left and right bottom panel end flaps hingedly connected to said left and right ends of said bottom panel;

(f) left and right front panel end flaps hingedly connected to said left and right ends of said front panel, said front panel having at least one sealing surface, said front panel hingedly connected to a flange lip;

wherein said first relief notch on said first smooth edge is adapted to substantially engage said left rear panel end flap and said second relief notch on said second smooth edge is adapted to substantially engage said right rear panel end flap when said blank is assembled to form said carton.

2. The blank of claim 1, wherein said front panel has a plurality of sealing surfaces and said outer surface of said in-folding flap is adapted for adhesive connection to said plurality of sealing surfaces on said front panel when said blank is assembled to form said carton.

3. The blank of claim 1, wherein said blank is made of paperboard and said sealing surface is die-cut in said paperboard.

4. A foldable blank to be used for forming a carton, said blank comprising:

a bottom panel having opposing first and second edges and opposing inner and outer surfaces;

a back panel having opposing first and second edges and opposing inner and outer surfaces, the first edge of said back panel being hingedly connected to the first edge of said bottom panel;

a top panel having opposing first and second edges and opposing inner and outer surfaces, the first edge of said top panel being hingedly connected to the second edge of said back panel opposite said bottom panel;

a cover panel having opposing first and second edges and opposing inner and outer surfaces, the first edge of said cover panel being hingedly connected to the second edge of said top panel opposite said back panel;

an in-folding flap hingedly connected to the second edge of said cover panel opposite said top panel, said in-folding flap having a releasable lock tab defined by a perforated border that allows said tab to be manually separated from said in-folding flap, said lock tab having opposing inner and outer surfaces;

a front panel having opposing first and second edges and opposing inner and outer surfaces, the first edge of said front panel being hingedly connected to the second edge of said bottom panel opposite said back panel;

said outer surface of said front panel having a decorated area coated with a decorative coating and an undecorated anchoring area free from said decorative coating, the nature of said decorative coating being such that said anchoring area has a higher affinity for adhesive bonding than said decorated area; and a pair of side panel and flap assemblies having inner and outer surfaces and being hingedly connected to opposing side edges of at least one of said front panel, said bottom panel, said back panel, said top panel, and said cover panel;

said panels and said side panel and flap assemblies being constructed and arranged such that said blank can be converted into a carton by (1) folding said in-folding flap about the hinged connection thereof and adhesively bonding the inner surface of said in-folding flap to the inner surface of said cover panel without adhesively bonding the inner surface of said lock tab to the inner surface of said cover panel and then adhesively bonding the outside surface of said lock tab to the anchoring area of said front panel and (2) thereafter moving said panels and said side panel and flap assemblies about the hinged connections thereof and fixing portions of said side panel and flap assemblies against movement with respect to said front, back and bottom panels in such a manner that the inner surfaces of said panels and said side panel and flap assemblies cooperate to define a closed interior space;

said releasable lock tab being constructed and arranged such that, when said blank is converted into a carton as aforesaid, said top panel can be lifted upwardly to provide access to the interior space by manually separating the lock tab from said in-folding flap along the perforated border thereof so that the lock tab remains adhesively bonded to said anchoring area while said top panel is lifted.

5. The blank of claim 4, wherein said in-folding flap has a plurality of said releasable lock tabs defined by a plurality of said perforated borders.

6. A foldable blank for assembling a carton, said blank comprising:

(a) an in-folding flap hingedly connected to a cover panel by a score line, said in-folding flap having an inner surface, an outer surface and a locking edge, said score line having a die-cut appendage;

(b) a front panel having at least one sealing surface, said front panel hingedly connected to a lip by a joint line; said joint line having at least one male tab; and (c) said inner surface of said in-folding flap is adapted for adhesive connection to said cover panel and said outer surface of said in-folding flap is adapted for adhesive connection to said sealing surface on said front panel, and said male tab is adapted to engage said locking edge of said in-folding flap when said blank is assembled to form said carton.

7. The blank of claim 6, wherein said joint line has a plurality of male tabs which are adapted to engage said locking edge of said in-folding flap when said blank is assembled to form said carton.

8. A foldable sleeve for assembling a carton, said sleeve comprising:

a bottom panel having opposing first and second edges and opposing inner and outer surfaces;

a back panel having opposing first and second edges and opposing inner and outer surfaces, the first edge of said back panel being hingedly connected to the first edge of said bottom panel;

a top panel having opposing first and second edges and opposing inner and outer surfaces, the first edge of said top panel being hingedly connected to the second edge of said back panel opposite said bottom panel;

a cover panel having opposing first and second edges and opposing inner and outer surfaces, the first edge of said cover panel being hingedly connected to the second edge of said top panel opposite said back panel;

an in-folding flap having opposing inner and outer surfaces and opposing first and second edges, the first edge of said in-folding flap being hingedly connected to the first edge of said cover panel opposite said top panel and the second edge of said in-folding flap defining a locking edge;

said in-folding flap being folded relative to said cover panel with the inner surface of said in-folding flap being adhesively bonded to the inner surface of said cover panel such that the locking edge of said in-folding flap faces generally towards said top panel;

a front panel having opposing first and second edges and opposing inner and outer surfaces, the first edge of said front panel being hingedly connected to the second edge of said bottom panel opposite said back panel;

a lip panel having opposing first and second edges and opposing inner and outer edges, the first edge of said lip panel being hingedly connected to the second edge of said front panel opposite said bottom panel and the second edge of said lip panel providing a locking edge;

said lip panel being folded outwardly with respect to said front panel such that the outer surface of said lip panel is engaged with the outer surface of said front panel and the outer surface of said in-folding flap being adhesively bonded to the outer surface of said front panel such that said locking edges of said in-folding flap and said lip panel are engaged with one another in an abutting relation; and a pair of side panel and flap assemblies having opposing inner and outer surfaces and being hingedly connected to opposing side edges of at least one of said top panel, said back panel, said bottom panel, said front panel, and said cover panel;

said panels and said side panel and flap assemblies being constructed and arranged such that said sleeve can be converted into a carton by moving said panels so as to space the inner surfaces of said panels apart from one another and form a pair of opposing open end portions, and thereafter manipulating said side panel and flap assemblies so as to close off said opposing open end portions and then fixing portions of said side panel and flap assemblies against movement with respect to said front, back, and bottom panels such that the inner surfaces of said panels and said side panel and flap assemblies cooperate to define a closed interior space.

9. The sleeve of claim 8, wherein said front panel has at least one sealing surface on said front panel and said underlying outer surface of said in-folding flap is adhesively connected to said sealing surface on said front panel.

10. The sleeve of claim 9, wherein said sleeve is made of paperboard and said sealing surface is die-cut in said paperboard.

11. A foldable sleeve for assembling a carton, said sleeve comprising:

(a) cover, top, rear, bottom and front panels hingedly connected in the order named, said cover, top, rear, bottom and front panels each having left and right ends;

(b) an in-folding flap connected to said cover panel, said in-folding flap having an inner surface, an underlying outer surface and a locking edge;

(c) left and right top panel end flaps hingedly connected to said left and right ends of said top panel, said left top panel end flap having a first smooth edge terminating in a first relief notch, said right top panel end flap having a second smooth edge terminating in a second relief notch;

(d) left and right rear panel end flaps hingedly connected to said left and right ends of said rear panel, said left rear panel end flap having a third smooth edge, said right rear panel end flap having a fourth smooth edge;

(e) left and right bottom panel end flaps hingedly connected to said left and right ends of said bottom panel;

(f) left and right front panel end flaps hingedly connected to said left and right ends of said front panel, said front panel having at least one sealing surface, said front panel hingedly connected to a flange lip;

(g) said inner surface of said in-folding flap is adhesively connected to said cover panel and said underlying outer surface of said in-folding flap is adhesively connected to said sealing surface on said front panel such that said flange lip connected to said front panel substantially engages said locking edge of said in-folding flap;

wherein said first relief notch on said first smooth edge is adapted to substantially engage said left rear panel end flap and said second relief notch on said second smooth edge is adapted to substantially engage said right rear panel end flap when said sleeve is assembled to form said carton.

12. The sleeve of claim 11, wherein said front panel has a plurality of sealing surfaces and said underlying outer surface of said in-folding flap is adhesively connected to said plurality of sealing surfaces on said front panel.

13. The sleeve of claim 11, wherein said sleeve is made of paperboard and said sealing surface is die-cut in said paperboard.

14. A foldable sleeve to be used for forming a carton, said sleeve comprising:

a bottom panel having opposing first and second edges and opposing inner and outer surfaces;

a back panel having opposing first and second edges and opposing inner and outer surfaces, the first edge of said back panel being hingedly connected to the first edge of said bottom panel;

a top panel having opposing first and second edges and opposing inner and outer surfaces, the first edge of said top panel being hingedly connected to the second edge of said back panel opposite said bottom panel;

a cover panel having opposing first and second edges and opposing inner and outer surfaces, the first edge of said cover panel being hingedly connected to the second edge of said top panel opposite said back panel;

an in-folding flap having opposing first and second edges and opposing inner and outer surfaces, the first edge of said in-folding flap being hingedly connected to the second edge of said cover panel, said in-folding flap having a releasable lock tab defined by a perforated border that allows said lock tab to be manually separated from said in-folding flap, said lock tab having opposing inner and outer surfaces;

a front panel having opposing first and second edges and opposing inner and outer surfaces, the first edge of said front panel being hingedly connected to the second edge of said bottom panel opposite said back panel;

said outer surface of said front panel having a decorated area coated with a decorative coating and an undecorated anchoring area free from said decorative coating, the nature of said decorative coating being such that said anchoring area has a higher affinity for adhesive bonding than said decorated area;

said in-folding flap being folded relative to said cover panel such that the second edge of said in-folding flap faces generally towards said top panel and the inner surface of said in-folding flap being adhesively bonded to the inner surface of said cover panel without adhesively bonding the inner surface of said lock tab to the inner surface of said cover panel;

the outer surface of said releasable lock tab being adhesively bonded to the anchoring area of said front panel so as to connect said front panel and said top panel; and a pair of side panel and flap assemblies having opposing inner and outer surfaces and being hingedly connected on opposing side edges of at least one of said top panel, said back panel, said bottom panel, said front panel, and said cover panel;

said panels and said side panel and flap assemblies being constructed and arranged such that said sleeve can be converted into a carton by moving panels so as to space the inner surfaces of said panels apart from one another and form a pair of opposing open end portions, and thereafter manipulating said side panel and flap assemblies so as to close off said opposing end portions and then fixing portions of said side panel and flap assemblies against movement with respect to said front, back, and bottom panels such that the inner surfaces of said panels and said side panel and flap assemblies cooperate to define a closed interior space;

said releasable lock tab being constructed and arranged such that, when sleeve is converted into said carton as aforesaid, said lock tab can be manually separated from said in-folding flap and said cover panel along the perforated border thereof so that the tab remains adhesively bonded to said anchoring area, thereby allowing said top panel to be lifted upwardly to provide access into the interior space.

15. The sleeve of claim 14, wherein said in-folding flap has a plurality of said releasable lock tabs defined by a plurality of said perforated borders.

16. A foldable sleeve for assembling a carton, said sleeve comprising:

(a) an in-folding flap connected to a cover panel, said in-folding flap having an inner surface, an underlying outer surface and a locking edge;

(b) a front panel having at least one sealing surface, said front panel hingedly connected to a lip by a joint line; said joint line having at least one male tab; and (c) said inner surface of said in-folding flap is adhesively connected to said cover panel and said underlying outer surface of said in-folding flap is adhesively connected to said sealing surface of said front panel, and said male tab is adapted to engage said locking edge of said in-folding flap when said sleeve is assembled to form said carton.

17. The sleeve of claim 16, wherein said front panel has a plurality of sealing surfaces and said underlying outer surface of said in-folding flap is adhesively connected to said plurality of sealing surfaces on said front panel.

18. The sleeve of claim 16, wherein said sleeve is made of paperboard and said sealing surface is die-cut in said paperboard.

19. The sleeve of claim 16, wherein said sleeve is made of paperboard, said joint line is a die-cut pattern and said male tab is die-cut to a depth of at least one-quarter the thickness of said paperboard.

20. The sleeve of claim 16, wherein said sleeve is made of paperboard, said joint line is a die-cut pattern and said male tab is die-cut to a depth of at least one-half the thickness of said paperboard.

21. The sleeve of claim 16, wherein said sleeve is made of paperboard, said joint line is a die-cut pattern and said male tab is die-cut to a depth of at least three-quarters the thickness of said paperboard.

22. The sleeve of claim 16 wherein said joint line has a plurality of male tabs which engage said locking edge of said in-folding flap.

23. The sleeve of claim 22, wherein said sleeve is made of paperboard, said joint line is a die-cut pattern and said plurality of male tabs are die-cut to a depth of at least one-quarter the thickness of said paper-board.

24. The sleeve of claim 22, wherein said sleeve is made of paperboard, said joint line is a die-cut pattern and said plurality of male tabs are die-cut to a depth of at least one-half the thickness of said paperboard.

25. The sleeve of claim 22, wherein said sleeve is made of paperboard, said joint line is a die-cut pattern and said plurality of male tabs are die-cut to a depth of at least three-quarters the thickness of said paperboard.

26. A foldable sleeve for assembling a carton, said sleeve comprising:

(a) cover, top, rear, bottom and front panels hingedly connected in the order named;

(b) an in-folding flap connected to said cover panel, said in-folding flap having an inner surface, an underlying outer surface and a locking edge;

(c) a front panel having at least one sealing surface, said front panel hingedly connected to a lip by a joint line; said joint line having at least one male tab; and (d) said inner surface of said in-folding flap is adhesively connected to said cover panel and said underlying outer surface of said in-folding flap is adhesively connected to said sealing surface on said front panel, and said male tab is adapted to engage said locking edge of said in-folding flap when said sleeve is assembled to form said carton.

27. A foldable sleeve for assembling a carton, said sleeve comprising:

(a) an in-folding flap connected to a cover panel by a score line, said in-folding flap having an inner surface, an underlying outer surface and a locking edge, said score line having a die-cut appendage;

(b) a front panel having at least one sealing surface, said front panel hingedly connected to a lip by a joint line; said joint line having at least one male tab; and (c) said inner surface of said in-folding flap is adhesively connected to said cover panel and said underlying outer surface of said in-folding flap is adhesively connected to said sealing surface on said front panel, and said male tab is adapted to engage said locking edge of said in-folding flap when said sleeve is assembled to form said carton.

28. The sleeve of claim 27, wherein said joint line has a plurality of male tabs which are adapted to engage said locking edge of said in-folding flap when said sleeve is assembled to form said carton.

29. A carton assembled from a foldable blank, said carton comprising:

a bottom panel having opposing first and second edges and opposing inner and outer surfaces;

a back panel having opposing first and second edges and opposing inner and outer surfaces, the first edge of said back panel being hingedly connected to the first edge of said bottom panel;

a top panel having opposing first and second edges and opposing inner and outer surfaces, the first edge of said top panel being hingedly connected to the second edge of said back panel opposite said bottom panel;

a cover panel having opposing first and second edges and opposing inner and outer surfaces, the first edge of said cover panel being hingedly connected to the second edge of said top panel opposite said back panel;

an in-folding flap having opposing inner and outer surfaces and opposing first and second edges, the first edge of said in-folding flap being hingedly connected to the first edge of said cover panel opposite said top panel and the second edge of said in-folding flap defining a locking edge;

said in-folding flap being folded relative to said cover panel with the inner surface of said in-folding flap being adhesively bonded to the inner surface of said cover panel such that the locking edge of said in-folding flap faces generally towards said top panel;

a front panel having opposing first and second edges and opposing inner and outer surfaces, the first edge of said front panel being hingedly connected to the second edge of said bottom panel opposite said back panel;

a lip panel having opposing first and second edges and opposing inner and outer surfaces, the first edge of said lip panel being hingedly connected to the second edge of said front panel opposite said bottom panel and the second edge of said lip panel defining a locking edge;

said lip panel being folded outwardly with respect to said front panel such that the outer surface of said lip panel is engaged with the outer surface of said front panel and the outer surface of said in-folding flap being adhesively bonded to the outer surface of said front panel such that the locking edges of said in-folding flap and said lip panel are engaged with one another in abutting relation; and a pair of side panel and flap assemblies having opposing inner and outer surfaces and being hingedly connected on opposing side edges of at least one of said top panel, said back panel, said bottom panel, said front panel, and said cover panel;

the inner surfaces of said panels and said side panel and flap assemblies being spaced apart from one another and portions of said side panel and flap assemblies being fixed against movement with respect to said front, back, and bottom panels such that the inner surfaces of said panels and said side panel and flap assemblies cooperate to define a closed interior space.

30. The carton of claim 29, wherein said front panel has at least one sealing surface and said underlying outer surface of said in-folding flap is adhesively connected to said sealing surface on said front panel.

31. The carton of claim 30, wherein said carton is made of paperboard and said sealing surface is die-cut in said paperboard.

32. A carton assembled from a foldable blank, said carton comprising:

(a) cover, top, rear, bottom and front panels hingedly connected in the order named, said cover, top, rear, bottom and front panels each having left and right ends;

(b) an in-folding flap connected to said cover panel, said in-folding flap having an inner surface, an underlying outer surface and a locking edge;

(c) left and right top panel end flaps hingedly connected to said left and right ends of said top panel, said left top panel end flap having a first smooth edge terminating in a first relief notch, said right top panel end flap having a second smooth edge terminating in a second relief notch;

(d) left and right rear panel end flaps hingedly connected to said left and right ends of said rear panel, said left rear panel end flap having a third smooth edge, said right rear panel end flap having a fourth smooth edge;

(e) left and right bottom panel end flaps hingedly connected to said left and right ends of said bottom panel;

(f) left and right front panel end flaps hingedly connected to said left and right ends of said front panel, said front panel having at least one sealing surface, said front panel hingedly connected to a flange lip;

(g) said inner surface of said in-folding flap is adhesively connected to said cover panel and said underlying outer surface of said in-folding flap is adhesively connected to said sealing surface on said front panel such that said flange lip connected to said front panel substantially engages said locking edge of said in-folding flap;

(h) said left bottom panel end flap is folded first, said left front panel end flap is folded second to overlie a portion of said left bottom panel end flap, said left top panel end flap is folded third, said left rear panel end flap is folded fourth such that said third smooth edge overlies a portion of said first smooth edge on said left top panel end flap;

(i) said right bottom panel end flap is folded first, said right front panel end flap is folded second to overlie a portion of said right bottom panel end flap, said right top panel end flap is folded third, said right rear panel end flap is folded fourth such that said fourth smooth edge overlies a portion of said second smooth edge on said right top panel end flap; and wherein said first relief notch on said first smooth edge substantially engages said left rear panel end flap and said second relief notch on said second smooth edge substantially engages said right rear panel end flap.

33. The carton of claim 32, wherein said front panel has a plurality of sealing surfaces and said underlying outer surface of said in-folding flap is adhesively connected to said plurality of sealing surfaces on said front panel.

34. The carton of claim 32, wherein said carton is made of paperboard and said sealing surface is die-cut in said paperboard.

35. A carton assembled from a foldable blank, said carton comprising:

a bottom panel having opposing first and second edges and opposing inner and outer surfaces;

a back panel having opposing first and second edges and opposing inner and outer surfaces, the first edge of said back panel being hingedly connected to the first edge of said bottom panel;

a top panel having opposing first and second edges and opposing inner and outer surfaces, the first edge of said top panel being hingedly connected to the second edge of said back panel opposite said bottom panel;

a cover panel having opposing first and second edges and opposing inner and outer surfaces, the first edge of said cover panel being hingedly connected to the second edge of said top panel opposite said back panel;

an in-folding flap having opposing first and second edges and opposing inner and outer surfaces, the first edge of said in-folding flap being hingedly connected to the second edge of said cover panel, said in-folding flap having a releasable lock tab defined by a perforated border that allows said lock tab to be manually separated from said in-folding flap, said lock tab having opposing inner and outer surfaces;

said in-folding flap being folded relative to said cover panel such that the second edge of said in-folding flap faces generally towards said top panel and the inner surface of said in-folding flap being adhesively bonded to the inner surface of said cover panel without adhesively bonding the inner surface of said lock tab to the inner surface of said cover panel;

a front panel having opposing first and second edges and opposing inner and outer surfaces, the first edge of said front panel being hingedly connected to the second edge of said bottom panel opposite said back panel;

said outer surface of said front panel having a decorated area coated with a decorative coating and an undecorated anchoring area free from said decorative coating, the nature of said decorative coating being such that said anchoring area has a higher affinity for adhesive bonding than said decorated area; and a pair of side panel and flap assemblies having opposing inner and outer surfaces and being hingedly connected on opposing side edges of at least one of said top panel, said back panel, said bottom panel, said front panel, and said cover panel;

the outer surface of said releasable lock tab being adhesively bonded to the anchoring area of said front panel so as to connect said front panel and said top panel and the inner surfaces of said panels and said side panel and flap assemblies being spaced apart from one another with portions of said side panel and flap assemblies being fixed against movement with respect to said front, back, and bottom panels such that the inner surfaces of said panels and said side panel and flap assemblies cooperate to define a closed interior space;

said releasable lock tab being constructed and arranged such that the lock tab can be manually separated from said in-folding flap and said cover panel along the perforated border thereof so that the tab remains adhesively bonded to said anchoring area, thereby allowing said top panel to be lifted upwardly to provide access into the interior space.

36. The carton of claim 35, wherein said in-folding flap has a plurality of releasable lock tabs defined by a plurality of corresponding perforated borders, each of said lock tabs having an inside surface and an outside surface, said inside surfaces of said lock tabs being free of adhesive; said outside surfaces of said lock tabs adhesively connected to said front panel; and said lock tabs are adapted for release from said corresponding perforated borders when said seal of said carton is broken and said lock tabs are adapted to lock with said corresponding perforated borders when said carton is resealed.

37. A carton assembled from a foldable blank, said carton comprising:

(a) an in-folding flap connected to a cover panel, said in-folding flap having an inner surface, an underlying outer surface and a locking edge;

(b) a front panel having at least one sealing surface, said front panel connected to a lip by a joint line; said joint line having at least one male tab; and (c) said inner surface of said in-folding flap is adhesively connected to said cover panel and said underlying outer surface of said in-folding flap is adhesively connected to said sealing surface on said front panel, and said male tab engages said locking edge of said in-folding flap.

38. The carton of claim 37, wherein said front panel has a plurality of sealing surfaces and said underlying outer surface of said in-folding flap is adhesively connected to said plurality of sealing surfaces on said front panel.

39. The carton of claim 37, wherein said carton is made of paperboard and said sealing surface is die-cut in said paperboard.

40. The carton of claim 37, wherein said carton is made of paperboard, said joint line is a die-cut pattern and said male tab is die-cut to a depth of at least one-quarter the thickness said paperboard.

41. The carton of claim 37, wherein said carton is made of paperboard, said joint line is a die-cut pattern and said male tab is die-cut to a depth of at least one-half the thickness of said paperboard.

42. The carton of claim 37, wherein said carton is made of paperboard, said joint line is a die-cut pattern and said male tab is die-cut to a depth of at least three-quarters the thickness of said paperboard.

43. The carton of claim 37, wherein said joint line has a plurality of male tabs which engage said locking edge of said in-folding flap.

44. The carton of claim 43, wherein said carton is made of paperboard, said joint line is a die-cut pattern and said plurality of male tabs are die-cut to a depth of at least one-quarter the thickness of said paperboard.

45. The carton of claim 43, wherein said carton is made of paperboard, said joint line is a die-cut pattern and said plurality of male tabs are die-cut to a depth of at least one-half the thickness of said paperboard.

46. The carton of claim 43, wherein said carton is made of paperboard, said joint line is a die-cut pattern and said plurality of male tabs are die-cut to a depth of at least three-quarters the thickness of said paperboard.

47. A carton assembled from a foldable blank, said carton comprising:

(a) cover, top, rear, bottom and front panels hingedly connected in the order named;

(b) an in-folding flap connected to said cover panel, said in-folding flap having an inner surface, an underlying outer surface and a locking edge;

(c) a front panel having at least one sealing surface, said front panel connected to a lip by a joint line; said joint line having at least one male tab; and (d) said inner surface of said in-folding flap is adhesively connected to said cover panel and said underlying outer surface of said in-folding flap is adhesively connected to said sealing surface on said front panel, and said male tab engages said locking edge of said in-folding flap.

48. A carton assembled from a foldable blank, said carton comprising:

(a) an in-folding flap connected to a cover panel by a score line, said in-folding flap having an inner surface, an underlying outer surface and a locking edge, said score line having a die-cut appendage;

(b) a front panel having at least one sealing surface, said front panel hingedly connected to a lip by a joint line; said joint line having at least one male tab; and (c) said inner surface of said in-folding flap is adhesively connected to said cover panel and said underlying outer surface of said in-folding flap is adhesively connected to said sealing surface on said front panel, and said male tab engages said locking edge of said in-folding flap.

49. The carton of claim 48, wherein said joint line has a plurality of male tabs which engage said locking edge of said in-folding flap.

50. A foldable paperboard blank to be used for forming a carton, said blank comprising:

a paperboard bottom panel having opposing first and second edges and opposing inner and outer surfaces;

a paperboard back panel having opposing first and second edges and opposing inner and outer surfaces, the first edge of said back panel being hingedly connected to the first edge of said bottom panel;

a paperboard top panel having opposing first and second edges and opposing inner and outer surfaces, said first edge of said top panel being hingedly connected to the second edge of said back panel opposite said bottom panel;

a paperboard cover panel having opposing first and second edges and opposing inner and outer edges, the first edge of said cover panel being hingedly connected to the second edge of said top panel opposite said back panel, said cover panel providing locking edge facing generally towards said top panel;

a paperboard front panel having opposing first and second edges and opposing inner and outer surfaces, the first edge of said front panel being hingedly connected to the second edge of said bottom panel opposite said back panel;

a paperboard lip panel having opposing first and second edges and opposing inner and outer surfaces, the first edge of said lip panel being hingedly connected to the second edge of said front panel;

said lip panel having a male tab defined by a cut line that is cut into the outer surface of said front panel adjacent the hinged connection between said front panel and said lip panel without extending through the entire thickness of said front panel, said lip panel, said front panel, and said cut line being constructed and arranged such that, when said lip panel and said front panel are folded so that said lip panel extends inwardly from the inner surface of said front panel, said male tab delaminates from said front panel without forming an opening through said front panel and extends outwardly from the outer surface of said front panel; and a pair of panel and flap assemblies hingedly connected on opposing side edges of at least one of said front panel, said top panel, said back panel, said bottom panel, and said cover panel;

said panels and said panel and flap assemblies being constructed and arranged such that said blank can be converted into a carton by (1) folding said lip panel relative to said front panel about the hinged connection thereof such that said male tab delaminates from said front panel as aforesaid and extends outwardly from the outer surface of said front panel and then adhesively bonding said cover panel in fixed relation with respect to said front panel such that the locking edge of said cover panel engages an underside surface of said male tab in an abutting relation, and (2) thereafter moving said panels and said side panel and flap assemblies about the hinged connections thereof and fixing portions of said side panel and flap assemblies against movement with respect to said front, back and bottom panels in such a manner that the inner surfaces of said side panel and flap assemblies cooperate to define a closed interior space.

51. The blank of claim 50, wherein said front panel has a plurality of sealing surfaces and said outer surface of said in-folding flap is adapted for adhesive connection to said plurality of sealing surfaces on said front panel when said blank is assembled to form said carton.

52. The blank of claim 50, wherein said blank is made of paperboard and said sealing surface is die-cut in said paperboard.

53. The blank of claim 50, wherein said blank is made of paperboard, said joint line is a die-cut pattern and said male tab is die-cut to a depth of at least one-quarter the thickness of said paperboard.

54. The blank of claim 50, wherein said blank is made of paperboard, said joint line is a die-cut pattern and said male tab is die-cut to a depth of at least one-half the thickness of said paperboard.

55. The blank of claim 50, wherein said blank is made of paperboard, said joint line is a die-cut pattern and said male tab is die-cut to a depth of at least three-quarters the thickness of said paperboard.

56. The blank of claim 50 wherein said joint line has a plurality of male tabs which engage said locking edge of said in-folding flap.

57. The blank of claim 56, wherein said blank is made of paperboard, said joint line is a die-cut pattern and said plurality of male tabs are die-cut to a depth of at least one-quarter the thickness of said paperboard.

58. The blank of claim 57, wherein said blank is made of paperboard, said joint line is a die-cut pattern and said plurality of male tabs are die-cut to a depth of at least one-half the thickness of said paperboard.

59. The blank of claim 56, wherein said blank is made of paperboard, said joint line is a die-cut pattern and said plurality of male tabs are die-cut to a depth of at least three-quarters the thickness of said paperboard.

60. A blank according to claim 50, wherein said lip panel and said front panel are hingedly connected along a cut joint line that includes the cut line which defines said male tab.

61. A blank according to claim 60, wherein said cut line is die-cut.

62. A blank according to claim 60, further comprising:

an in-folding flap having opposing first and second edges and opposing inner and outer surfaces, the first edge of said in-folding flap being hingedly connected to the second edge of said cover panel, said in-folding flap being constructed and arranged to be folded relative to said cover panel and have the inner surface thereof adhesively bonded to the inner surface of said cover panel such that the second edge of said in-folding flap provides said locking edge.

63. A foldable paperboard sleeve to be used for forming a carton, said sleeve comprising:

a paperboard bottom panel having opposing first and second edges and opposing inner and outer surfaces;

a paperboard back panel having opposing first and second edges and opposing inner and outer surfaces, the first edge of said back panel being hingedly connected to the first edge of said bottom panel;

a paperboard top panel having opposing first and second edges and opposing inner and outer surfaces, said first edge of said top panel being hingedly connected to the second edge of said back panel opposite said bottom panel;

a paperboard cover panel having opposing first and second edges and opposing inner and outer edges, the first edge of said cover panel being hingedly connected to the second edge of said top panel opposite said back panel, said cover panel providing a locking edge facing generally towards said top panel;

a paperboard front panel having opposing first and second edges and opposing inner and outer surfaces, the first edge of said front panel being hingedly connected to the second edge of said bottom panel opposite said back panel;

a paperboard lip panel having opposing first and second edges and opposing inner and outer surfaces, the first edge of said lip panel being hingedly connected to the second edge of said front panel;

said lip panel having a male tab defined by a cut line that is cut into the outer surface of said front panel adjacent the hinged connection between said front panel and said lip panel without extending through the entire thickness of said front panel, said lip panel being folded relative to said front panel such that said lip panel extends inwardly from the inner surface of said front panel and such that said male tab has been delaminated from said front panel without forming an opening through said front panel and extends outwardly from the outer surface of said front panel;

said cover panel being adhesively bonded in fixed relation with respect to said front panel such that the locking edge of said cover panel engages an underside surface of said male tab in an abutting relation; and a pair of panel and flap assemblies hingedly connected on opposing side edges of at least one of said front panel, said top panel, said back panel, said bottom panel, and said cover panel;

said panels and said side panel and flap assemblies being constructed and arranged such that said sleeve can be converted into a carton by moving panels so as to space the inner surfaces of said panels apart from one another and form a pair of opposing open end portions, and thereafter manipulating said side panel and flap assemblies so as to close off said opposing end portions and then fixing portions of said side panel and flap assemblies against movement with respect to said front, back, and bottom panels such that the inner surfaces of said panels and said side panel and flap assemblies cooperate to define a closed interior space.

64. A sleeve according to claim 63, wherein said lip panel and said front panel are hingedly connected along a cut joint line that includes the cut line which defines said male tab.

65. A sleeve according to claim 64, wherein said cut line is die-cut.

66. A carton assembled from a foldable blank, said carton comprising:

a paperboard bottom panel having opposing first and second edges and opposing inner and outer surfaces;

a paperboard back panel having opposing first and second edges and opposing inner and outer surfaces, the first edge of said back panel being hingedly connected to the first edge of said bottom panel;

a paperboard top panel having opposing first and second edges and opposing inner and outer surfaces, said first edge of said top panel being hingedly connected to the second edge of said back panel opposite said bottom panel;

a paperboard cover panel having opposing first and second edges and opposing inner and outer edges, the first edge of said cover panel being hingedly connected to the second edge of said top panel opposite said back panel, said cover panel providing a locking edge facing generally towards said top panel;

a paperboard front panel having opposing first and second edges and opposing inner and outer surfaces, the first edge of said front panel being hingedly connected to the second edge of said bottom panel opposite said back panel;

a paperboard lip panel having opposing first and second edges and opposing inner and outer surfaces, the first edge of said lip panel being hingedly connected to the second edge of said front panel;

said lip panel having a male tab defined by a cut line that is formed into the outer surface of said front panel adjacent the hinged connection between said front panel and said lip panel without extending through the entire thickness of said front panel, said lip panel being folded relative to said front panel such that said lip panel extends inwardly from the inner surface of said front panel and such that said male tab has been delaminated from said front panel without forming an opening through said front panel and extends outwardly from the outer surface of said front panel; and a pair of panel and flap assemblies hingedly connected on opposing side edges of at least one of said front panel, said top panel, said back panel, said bottom panel, and said cover panel;

said cover panel being adhesively bonded in fixed relation with respect to said front panel such that the locking edge of said cover panel engages an underside surface of said male tab in an abutting relation and said side panel and flap assemblies being spaced apart from one another with portions said side panel and flap assemblies being fixed against movement with respect to said front, back, and bottom panels such that the inner surfaces of said panels and said side panel and flap assemblies cooperate to define a closed interior space.

67. A blank according to claim 66, wherein said lip panel and said front panel are hingedly connected along a cut joint line that includes the cut line which defines said male tab.

68. A blank according to claim 67, wherein said cut line is die-cut.

* * * * *